US009080304B1

(12) United States Patent
Roberts et al.

(10) Patent No.: US 9,080,304 B1
(45) Date of Patent: Jul. 14, 2015

(54) COLLAPSIBLE, MULTI-LAP FOUNDATION ASSEMBLY

(71) Applicant: Oddello Industries, LLC, Morristown, TN (US)

(72) Inventors: Thomas A. Roberts, Dandridge, TN (US); Shawn M. Parella, Morristown, TN (US)

(73) Assignee: Oddello Industries, LLC, Morristown, TN (US)

( * ) Notice: Subject to any disclaimer, the term of this patent is extended or adjusted under 35 U.S.C. 154(b) by 0 days.

(21) Appl. No.: 14/607,938

(22) Filed: Jan. 28, 2015

Related U.S. Application Data

(63) Continuation-in-part of application No. 29/490,132, filed on May 7, 2014.

(51) Int. Cl.
*B65D 19/00* (2006.01)
*E02D 27/32* (2006.01)

(52) U.S. Cl.
CPC ..... *E02D 27/32* (2013.01); *B65D 2519/00323* (2013.01); *B65D 2519/00398* (2013.01); *B65D 2519/00402* (2013.01); *B65D 2519/00502* (2013.01); *B65D 2519/00587* (2013.01); *B65D 2519/00592* (2013.01); *B65D 2519/00646* (2013.01)

(58) Field of Classification Search
CPC ..... B65D 2519/00; B65D 2519/00323; B65D 2519/00402; B65D 2519/00398; B65D 2519/00502; B65D 2519/00587; B65D 2519/00592; B65D 2519/00646
USPC ..... 108/51.3, 56.3, 901, 902, 160, 56.1, 108/57.17, 51.11, 57.18, 53.1, 53.3; 5/202, 5/174, 177
See application file for complete search history.

(56) References Cited

U.S. PATENT DOCUMENTS

| | | | | |
|---|---|---|---|---|
| 2,063,720 | A | 4/1935 | Blau | |
| 2,136,761 | A | 4/1936 | Simmons | |
| 2,925,947 | A | 9/1957 | Brown | |
| 3,133,511 | A * | 5/1964 | Phillips | 108/55.1 |
| 3,469,542 | A * | 9/1969 | Ahlenius | 108/56.1 |
| 3,580,471 | A | 5/1971 | Burke | |
| 3,736,605 | A * | 6/1973 | Klein, Jr. | 5/679 |
| 3,752,089 | A * | 8/1973 | Bartels | 108/161 |
| 4,771,995 | A | 9/1988 | Wells et al. | |
| 4,788,727 | A * | 12/1988 | Liu | 5/679 |
| 4,970,743 | A | 11/1990 | Wride et al. | |

(Continued)

FOREIGN PATENT DOCUMENTS

CN 201777544 3/2011

*Primary Examiner* — Chi Q Nguyen
(74) *Attorney, Agent, or Firm* — Shaddock Law Group, PC

(57) ABSTRACT

A collapsible, multi-lap foundation assembly having four perimeter rails; a plurality of rib elements, each having a central rib portion and flexible rib tab elements formed at each end of the central rib portion, and a plurality of half-lap rib joints extending from an upper portion of the central rib portion; and a plurality of spine elements, each having a central spine portion and flexible spine tab elements formed at each end of the central spine portion, and a plurality of half-lap spine joints extending from a lower portion of the central spine portion; wherein the spine elements are aligned with the rib elements in an interlocking fashion; and wherein the rib tab elements are attached or coupled to an interior surface of two perimeter rails and the spine tab elements are attached or coupled to an interior surface of two perimeter rails.

20 Claims, 25 Drawing Sheets

(56) References Cited

U.S. PATENT DOCUMENTS

| | | | | | |
|---|---|---|---|---|---|
| 5,487,345 | A * | 1/1996 | Winebarger et al. | 108/51.3 |
| 5,564,140 | A | 10/1996 | Shoenhair et al. | |
| 5,953,775 | A * | 9/1999 | Mauro et al. | 5/201 |
| 5,958,171 | A | 9/1999 | Grigsby et al. | |
| 6,155,181 | A * | 12/2000 | Chilcutt | 108/51.3 |
| 6,196,449 | B1 | 3/2001 | Chen | |
| 8,448,582 | B2 * | 5/2013 | Jian | 108/56.3 |
| 8,490,228 | B2 * | 7/2013 | Blyskal et al. | 5/285 |
| 8,499,956 | B2 | 8/2013 | Westrate et al. | |
| 8,591,836 | B2 * | 11/2013 | Boege et al. | 422/552 |
| 8,607,380 | B2 | 12/2013 | Chang et al. | |
| 2004/0226490 | A1 * | 11/2004 | Polumbaum | 108/56.1 |
| 2008/0047473 | A1 * | 2/2008 | Ferguson | 108/56.1 |

* cited by examiner

COLLAPSIBLE, MULTI-LAP FOUNDATION ASSEMBLY

CROSS-REFERENCE TO RELATED APPLICATIONS

This patent application claims the benefit of U.S. patent application Ser. No. 29/490,132, filed May 7, 2014, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to foundation assemblies. In particular, the present invention relates to a foundation assembly having a multi-lap construction and a method for constructing the foundation assembly.

2. Description of Related Art

Typically, mattress foundations and bases are constructed by hand from various pieces of Pine or other lightweight woods. These built-up mattress foundations are generally formed in rectangular fashion and are sometimes sawed at each corner in an effort to replicate the rounded corners of conventional mattresses.

Various external jigs and fixtures must be used in order to assemble the numerous components of the mattress foundations. Once aligned, the various pieces or components are typically nailed together.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, constructing mattress foundations using known methods is typically time-consuming, requires relatively skilled workers, requires numerous components and tools, and does not always result in a secure or square mattress foundation. Furthermore, once assembled, the mattress foundations are typically stacked for shipping, which requires a rather substantial amount of space in order to ship or otherwise transport the assembled mattress foundations.

Thus, the present invention relates generally to improved foundation assemblies. In particular, the present invention relates to improved mattress foundation assemblies and a method for constructing the mattress foundation assemblies. In various exemplary embodiments, the foundation assembly frame is configured such that it can be folded/collapsed for transportation. When opposing frame members are brought into alignment with one another (and the frame is unfolded), the frame forms a substantially square or rectangular foundation, with a multi-lap, interior support structure.

Once unfolded, corner connectors can be placed at each corner to maintain the unfolded configuration of the foundation frame. Additionally, a deck piece can be placed over top of the interior support structure and a portion of the frame members to create a complete foundation.

In various exemplary embodiments, the foundation assembly is constructed of Medium Density Fiberboard (MDF), cardboard, and/or plastic components. The foundation assembly is constructed such that prior to installation of the corner connector elements, the foundation assembly can be folded or collapsed such that the foundation assembly does not occupy a comparatively significant amount of space. In this manner, a new large number of folded or collapsed foundation assemblies can easily be transported or shipped. Assembly of the folded or collapsed foundation assemblies is a simple matter of unfolding or expanding the foundation assembly and attaching or coupling the four corner connector elements at the proximate corners of the unfolded or expanded foundation assembly.

In various exemplary embodiments, the foundation assembly comprises four shaped perimeter rails (first and second side rail elements and first and second header elements) attached or coupled together via a series of interior support rib elements and spine elements.

The interior support rib elements each comprise an elongate, central portion with a tab element formed at each end of the central portion. The central portion is joined to each tab element via a hinge portion, such that each tab element is able to flex relative to the central portion. A plurality of half-lap joints are formed so as to extend from an upper portion of the central portion, at spaced apart locations.

Similarly, the interior support spine elements each comprise an elongate, central portion with a tab element formed at each end of the central portion. The central portion is joined to each tab element via a hinged portion, such that each tab element is able to flex relative to the central portion. A plurality of half-lap joints are formed so as to extend from a lower portion of the central portion, at spaced apart locations.

The rib elements and spine elements are attached or coupled together in an interlocking fashion by interaction of the respective half-lap joints and form the load distribution structure of the foundation. The rib tab elements and the spine tab elements are attached or coupled along an interior surface of the perimeter rails. Thus, by coordinated flexing of the tab elements, via the hinge portions, the assembled perimeter rails, rib elements, and spine elements are able to be folded or collapsed to a reduced sized assembly.

When unfolded or expanded, such that a longitudinal axis of the rib elements is substantially perpendicular to a longitudinal axis of the spine elements, the longitudinal axes of the side rail elements are substantially parallel to one another and the longitudinal axes of the header elements are also substantially parallel to one another.

When unfolded or expanded, the corner connector elements are inserted between adjacent ends of the side rail elements and header elements to form the foundation assembly.

In various exemplary embodiments, a top deck panel is attached or coupled atop the rib elements and spine elements. In certain exemplary embodiments, a top deck panel is attached or coupled atop the rib elements, the spine elements, and the perimeter rails. In this manner, the interaction between the rib elements, the spine elements, and the top deck panel serves to square the entire foundation after assembly.

In various exemplary, nonlimiting embodiments, the profile of the perimeter rails has been designed to provide smooth, rounded horizontal outer edges, and includes a recessed notch to accommodate a flush-mounted top deck panel.

The interior support ribs and spine element are attached together in an interlocking fashion by means of engineered half-lap joints and form the load distribution structure of the foundation. The ribs and spine element, along with the top deck panel also serve to square the entire foundation assembly during and after assembly.

Aesthetically, the corner connector elements serve to round the vertical outer edges of the foundation assembly, while maintaining the radii of the foundation assembly's top and bottom edges. Structurally, the corner connector elements provide substantial impact resistance to corner loading and flexible resistance to parallelogram deformation. In various exemplary embodiments, these qualities are improved through the inclusion of a series of molded gussets inside the corner connector elements.

The top deck panel is typically a sheet of thinner MDF, or other material, which provides a single, solid surface upon which the mattress will sit. A solid top deck panel is particularly critical for foam mattresses and is a major improvement over currently constructed mattress foundations, which use soft cardboard atop lumber slats.

In various exemplary embodiments, the various elements of the foundation assembly are fastened together with adhesives. Alternatively, screws or other fastening means may be used to assemble the elements of the foundation. In still other embodiments, both adhesive and screws or other fastening means may be used.

Accordingly, this invention provides a foundation assembly of improved design.

This invention separately provides a foundation assembly that can be folded or collapsed for transportation and/or shipping.

This invention separately provides a foundation assembly that can be assembled without using tools.

This invention separately provides a foundation assembly having improved structural stability.

This invention separately provides a foundation assembly that can be assembled without the need for external jigs and/or fixtures.

This invention separately provides a foundation assembly that can be scaled to accommodate any size mattress.

This invention separately provides a foundation assembly that is less expensive to manufacture.

This invention separately provides a corner connector element of improved design.

This invention separately provides a scalable corner connector element.

This invention separately provides a corner connector element that is relatively light weight.

This invention separately provides a corner connector element that can be produced in mass quantity from plastic, wood, or other any other suitable material.

These and other aspects, features, and advantages of the present invention are described in or are apparent from the following detailed description of the exemplary, non-limiting embodiments of the present invention and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present invention.

Any benefits, advantages, or solutions to problems that are described herein with regard to specific embodiments are not intended to be construed as a critical, required, or essential feature(s) or element(s) of the present invention or the claims.

BRIEF DESCRIPTION OF THE SEVERAL VIEWS OF THE DRAWINGS

As required, detailed exemplary embodiments of the present invention are disclosed herein; however, it is to be understood that the disclosed embodiments are merely exemplary of the invention that may be embodied in various and alternative forms, within the scope of the present invention. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

Figure 1:
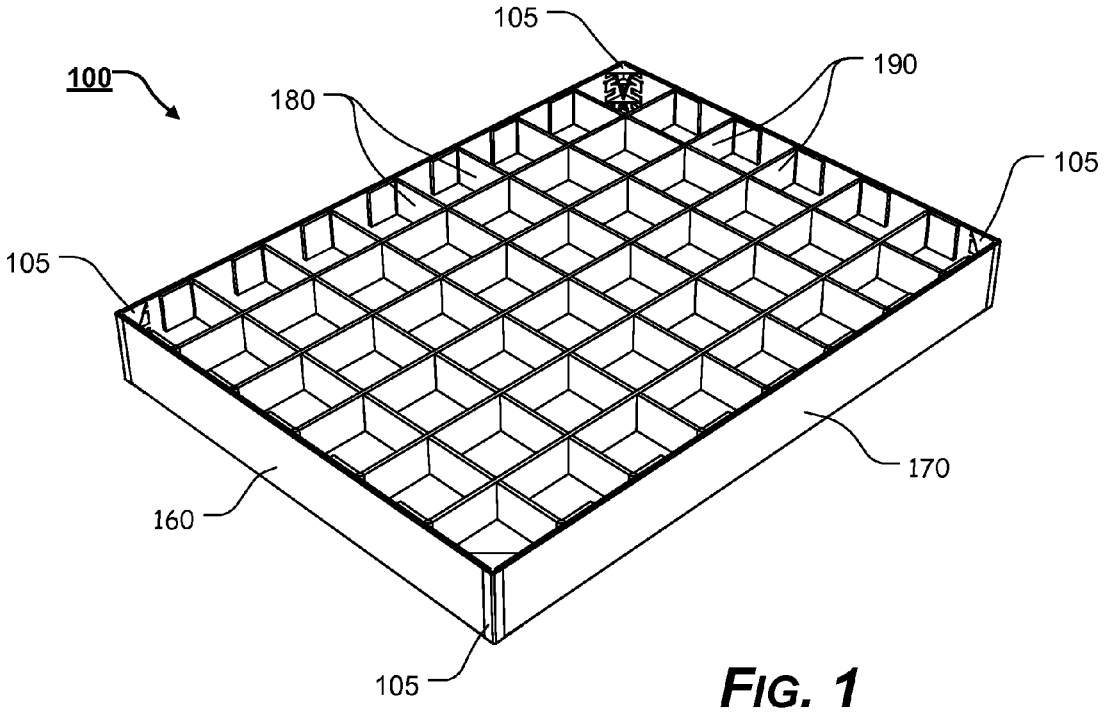
FIG. 1 shows an upper perspective view of a first exemplary embodiment of a foundation assembly, according to this invention.
Figure 2:
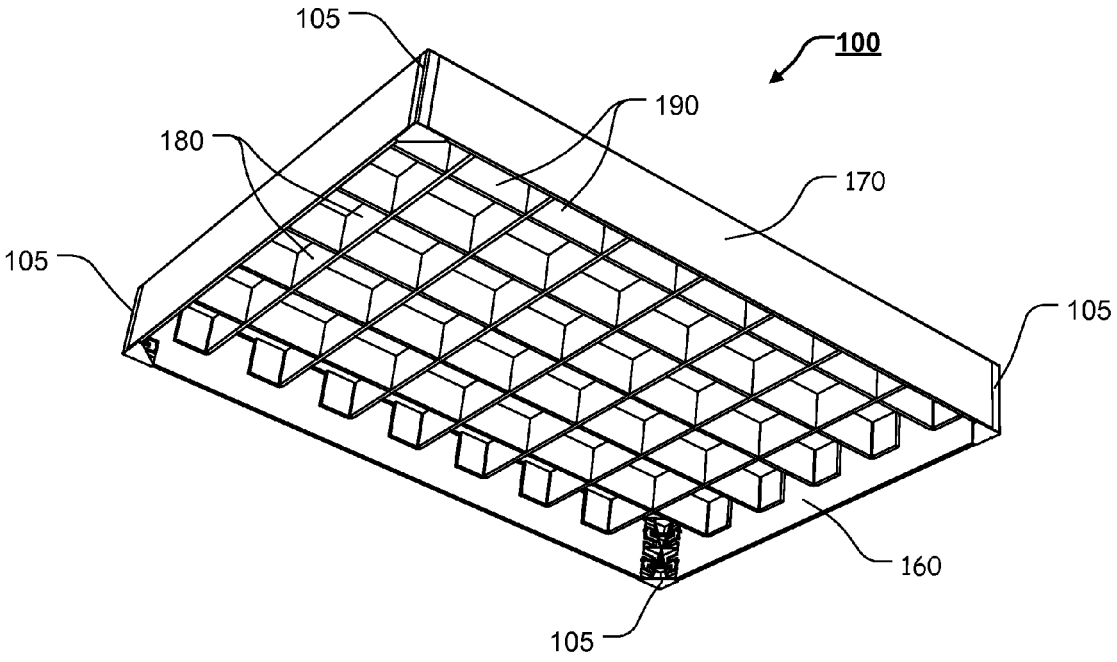
FIG. 2 shows an lower perspective view of a first exemplary embodiment of a foundation assembly, according to this invention.
Figure 3:
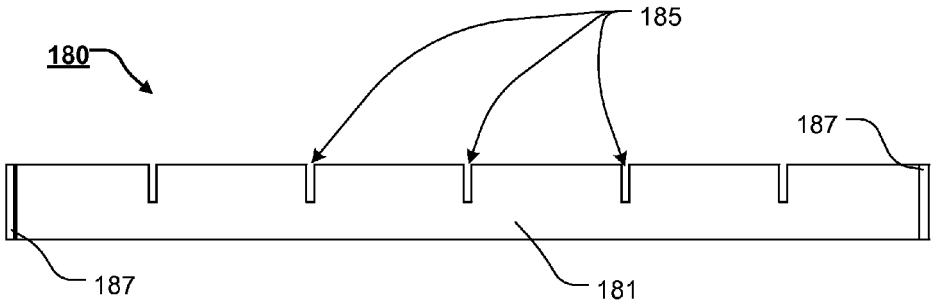
FIG. 3 shows a side view of a first exemplary embodiment of a rib element, according to this invention.
Figure 4:
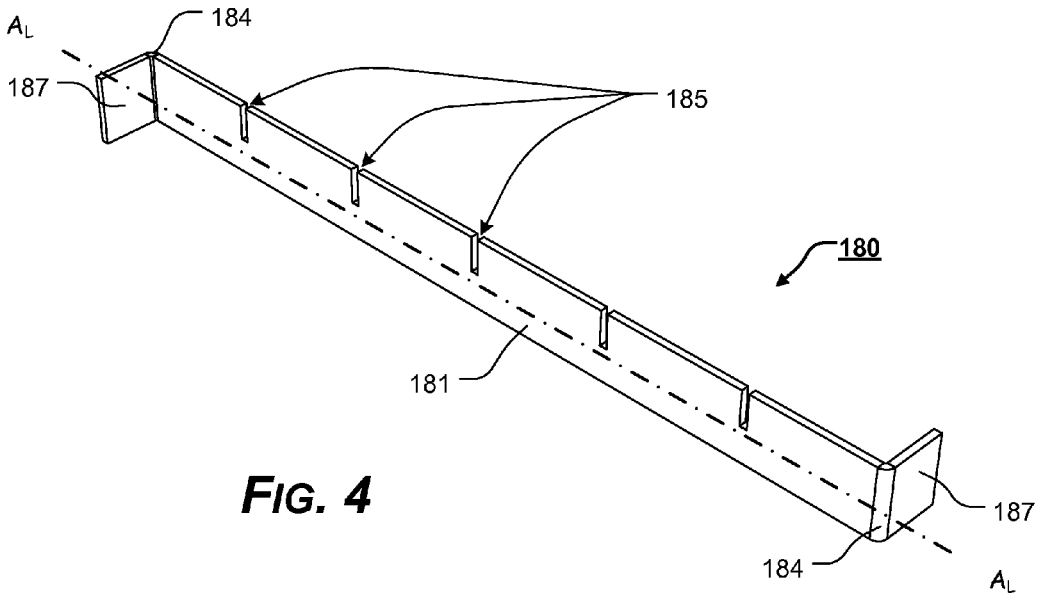
FIG. 4 shows an upper perspective view of a first exemplary embodiment of a rib element, according to this invention.
Figure 5:
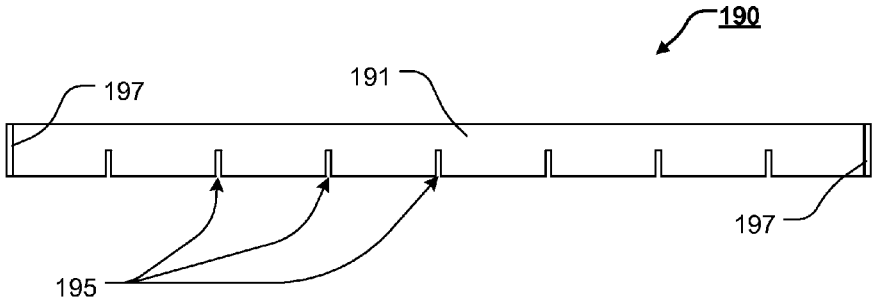
FIG. 5 shows a side view of a first exemplary embodiment of a spine element, according to this invention.
Figure 6:
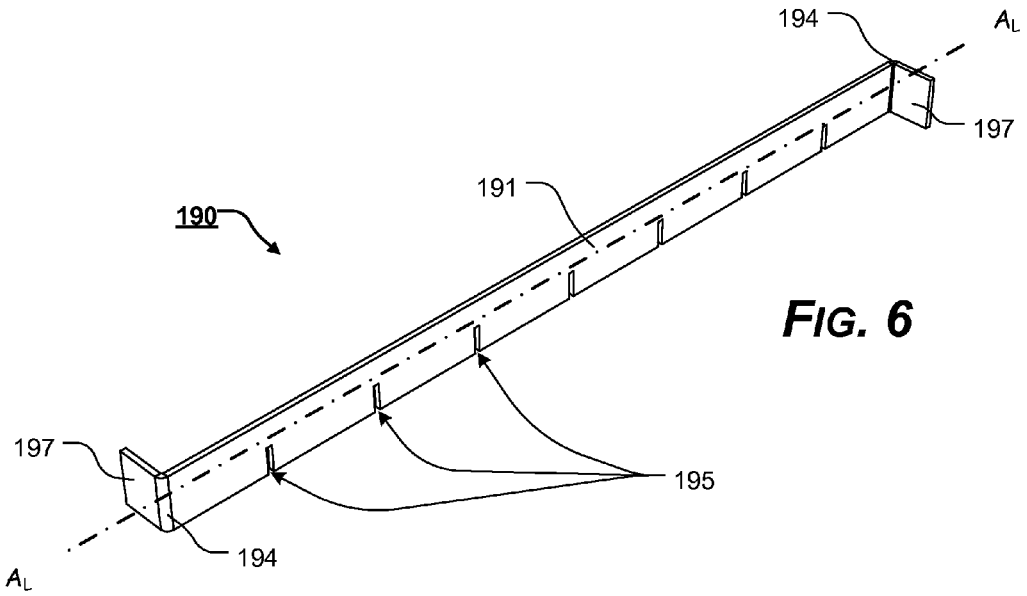
FIG. 6 shows an upper perspective view of a first exemplary embodiment of a spine element, according to this invention.

For simplicity and clarification, the design factors and operating principles of the mattress foundation corner connectors and mattress foundation assemblies according to this invention are explained with reference to various exemplary embodiments of foundation corner connectors and/or foundation assemblies according to this invention. The basic explanation of the design factors and operating principles of the foundation corner connectors and foundation assemblies is applicable for the understanding, design, and operation of the foundation corner connectors and foundation assemblies of this invention. It should be appreciated that the foundation corner connectors and/or the foundation assemblies can be adapted to many applications where a simplified corner connector and/or a foundation assembly is needed.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "mattress foundation", "foundation assembly", and "corner connector" are used for basic explanation and understanding of the operation of the systems, methods, and apparatuses of this invention. Therefore, the terms "mattress foundation", "foundation assembly", and "corner connector" are not to be construed as limiting the systems, methods, and apparatuses of this invention. Thus, the terms "mattress foundation" and "foundation assembly"" are to be understood to broadly include any structures or devices capable of supporting a load, while the term "corner connector" is to be understood to broadly include any structure or device capable of permanently or removably joining two elements at a given angle.

For simplicity and clarification, the foundation assembly of this invention will be described as being used in conjunction with a mattress. However, it should be appreciated that these are merely exemplary embodiments of the foundation assembly and are not to be construed as limiting this invention. Thus, the foundation assembly of this invention may be utilized in conjunction with any object or device and may be utilized as a foundation or support structure for bedding or furniture or may be utilized as a foundation or support for other devices, such as a stage, a platform, etc.

Turning now to the drawing FIGS., FIGS. 1-22 illustrate a first exemplary embodiment of a foundation assembly 100, according to this invention, while FIGS. 23-33 illustrate a first exemplary embodiment of a corner connector element 105 according to this invention.

In various exemplary embodiments, the foundation assembly 100 comprises four shaped perimeter rails 160 and 170. In various exemplary embodiments, the perimeter rails 160 and 170 comprise first and second side rail elements 170 and first and second header elements 160) attached or coupled together via a series of interior support rib elements 180 and spine elements 190.

The interior support rib elements 180 each comprise an elongate, central rib portion 181 with a rib tab element 187 formed at each end of the central rib portion 181. The central rib portion 181 is joined to each rib tab element 187 via a rib hinge portion 184, such that each rib tab element 187 is able to flex relative to the central rib portion 181. In various exemplary embodiments, the rib hinge portion 184 comprises a crimp or fold line formed in the rib element 180. Alternatively, the rib hinge portion 184 may comprise a fabric hinge element or a hinge that joins the rib tab element 187 to the central rib portion 181.

A plurality of half-lap rib joints 185 are formed so as to extend from an upper portion of the central rib portion 181, at spaced apart locations.

Similarly, the interior support spine elements 190 each comprise an elongate, central spine portion 191 with a spine tab element 197 formed at each end of the central spine portion 191. The central spine portion 191 is joined to each spine tab element 197 via a spine hinge portion 194, such that each spine tab element 197 is able to flex relative to the central spine portion 191. In various exemplary embodiments, the spine hinge portion 194 comprises a crimp or fold line formed in the spine element 190. Alternatively, the spine hinge portion 194 may comprise a fabric hinge element or a hinge that joins the spine tab element 197 to the central spine portion 191.

A plurality of half-lap spine joints 195 are formed so as to extend from a lower portion of the central spine portion 191, at spaced apart locations.

It should be appreciated that the number of half-lap rib joints 185 and corresponding half-lap spine joints 195 is a design choice based upon the desired functionality, rigidity, and/or strength of the foundation assembly 100.

Figure 7:
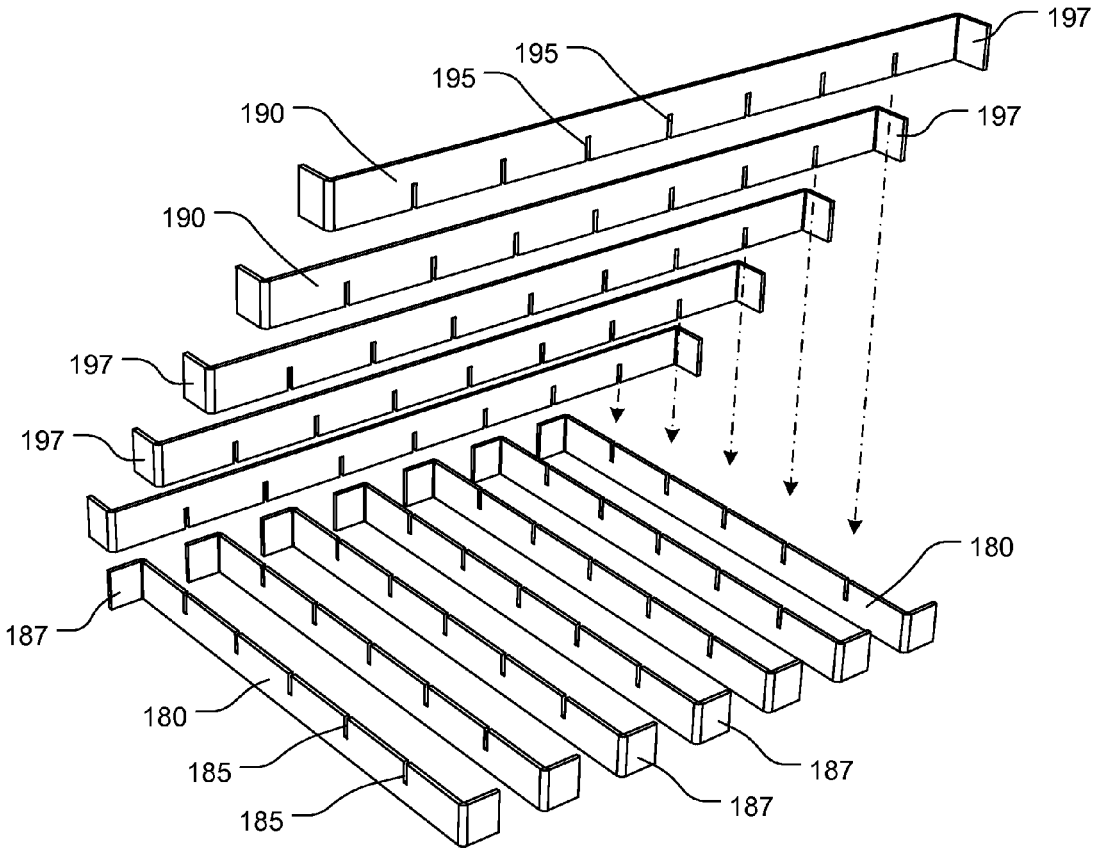
FIG. 7 shows an exploded, perspective view illustrating the assembly of rib elements and spine elements, according to this invention.
Figure 8:
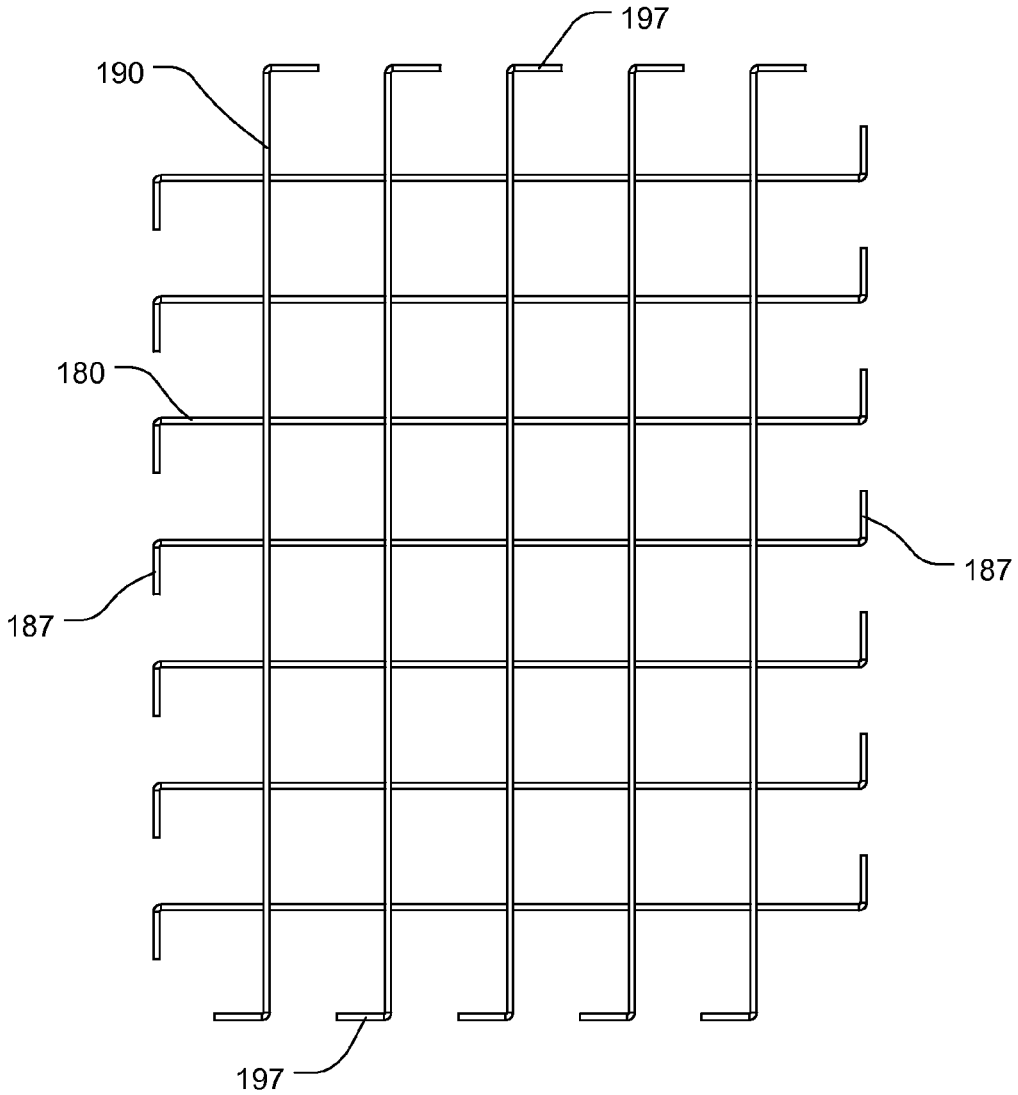
FIG. 8 shows a top view of the assembled rib elements and spine elements, in an unfolded or expanded configuration, according to this invention.
Figure 9:
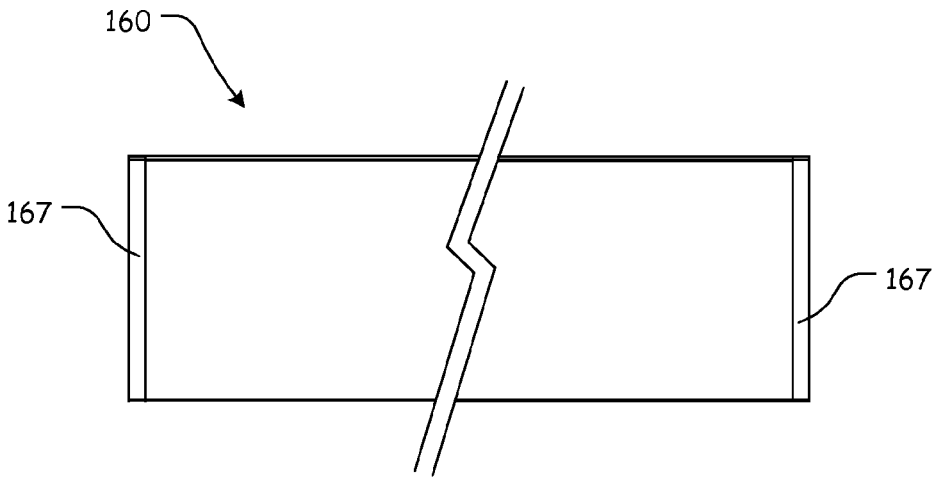
FIG. 9 shows a side view of an outer wall of a first exemplary embodiment of a perimeter rail, according to this invention.

In certain exemplary embodiments, as illustrated most clearly in FIGS. 7 and 8, during initial assembly of the foundation assembly 100, the rib elements 180 may be spaced apart from one another and arranged such that the longitudinal axes of the central rib portions 181 are parallel to one another, with half-lap rib joints 185 also arranged parallel to one another. The spine elements 190 are then attached or coupled to the aligned rib elements 180 in an interlocking fashion by interaction of the respective half-lap rib joints 185 and half-lap spine joints 195. Once joined, the rib elements 180 and the spine elements 190 form the inner load distribution structure of the foundation assembly 100.

Once the rib elements 180 and the spine elements 190 are appropriately joined, an outer surface of the rib tab elements 187 and an outer surface of the spine tab elements 197 is attached or coupled along an interior surface of the perimeter rails 160 and 170.

In various exemplary embodiments, the rib tab elements 187 and spine tab elements 197 are attached or coupled to the interior surface of the perimeter rails 160 and 170 with adhesives. Alternatively, screws or other fastening means may be used to attach or couple the rib tab elements 187 and spine tab elements 197 to the perimeter rails 160 and 170. In still other embodiments, both adhesive and screws or other fastening means may be used.

In certain other exemplary embodiments, the rib tab elements 187 of the rib elements 180 may be appropriately attached or coupled, at spaced apart locations, along an interior surface of the side rails 170. The spine tab elements 197 of the spine elements 190 may also be appropriately attached or coupled, at spaced apart locations, along an interior surface of the header rails 160. Once configured, the spine elements 190 and attached or coupled header elements 160 are then attached or coupled to the aligned rib elements 180 and attached or coupled side rail elements 170 in an interlocking fashion by interaction of the respective half-lap rib joints 185 and half-lap spine joints 195.

In various exemplary, nonlimiting embodiments, the profile of the perimeter rails 160 and 170 provides a smooth, rounded, horizontal outer edges, and includes a recessed notch 169 to accommodate a flush-mounted top deck panel 182. Aesthetically, the corner connector elements serve to round the vertical outer edges of the foundation assembly 100, while maintaining the radii of the top and bottom edges of the foundation assembly 100. Structurally, the corner connector elements 105 provide substantial impact resistance to corner loading and flexible resistance to parallelogram deformation. In various exemplary embodiments, these qualities are improved through the inclusion of a series of molded gussets inside the corner connector elements 105.

Figure 14:
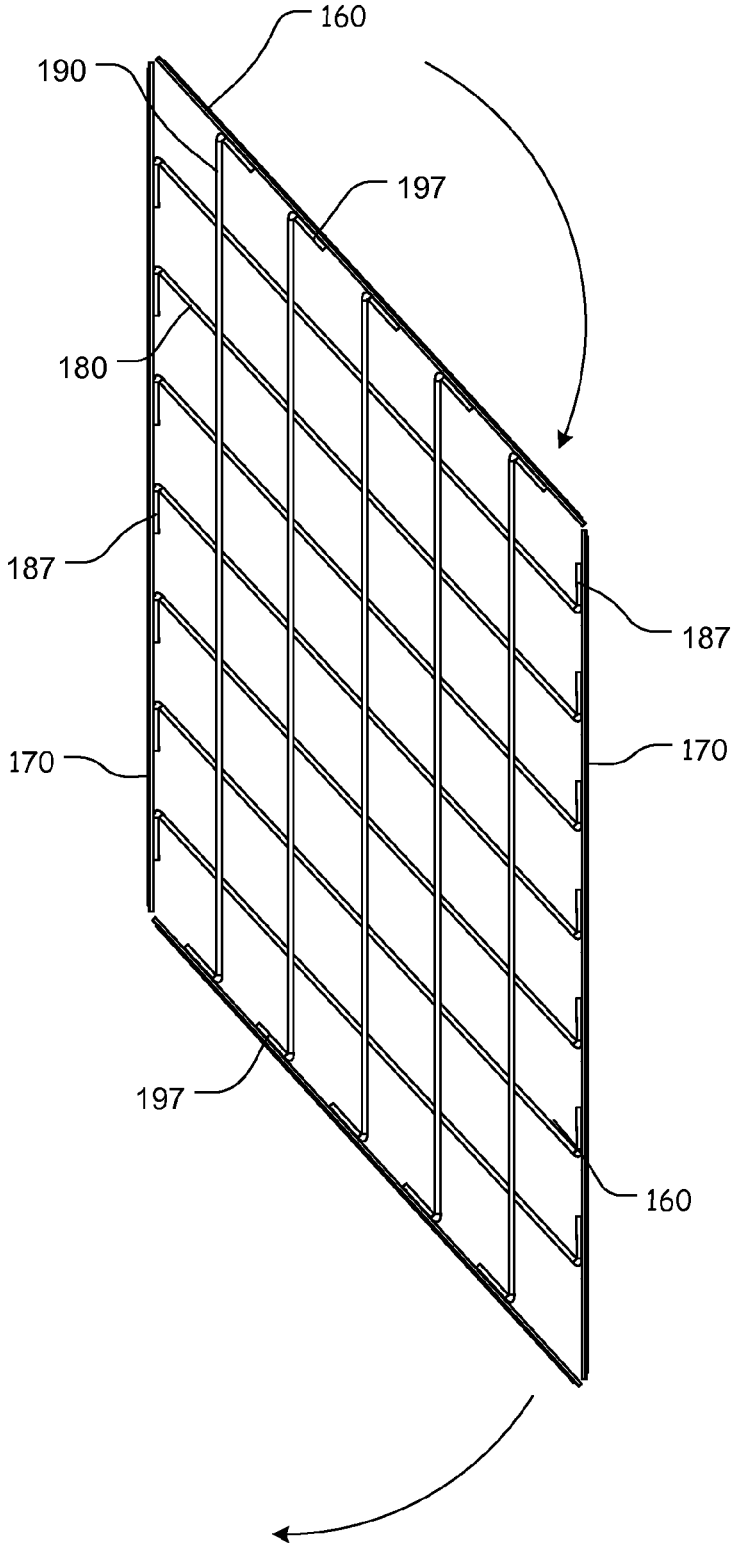
FIG. 14 shows a top view of the assembled rib elements, spine elements, and perimeter rails, in a partially folded or collapsed configuration, according to this invention.
Figure 15:
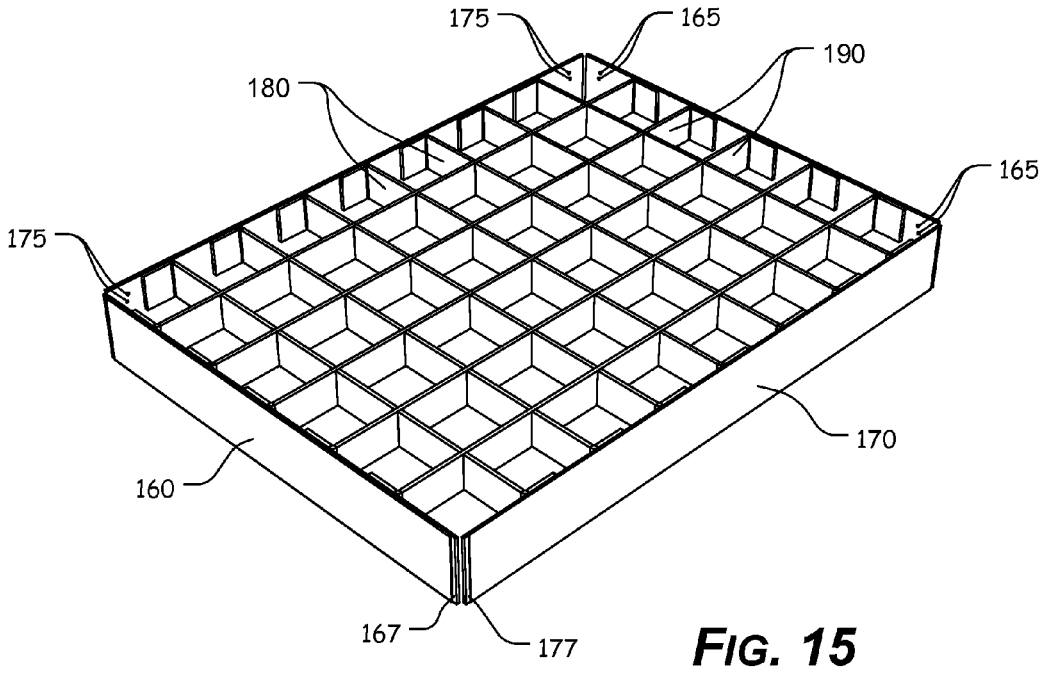
FIG. 15 shows a perspective view of the assembled rib elements, spine elements, and perimeter rails, in an unfolded or expanded configuration, according to this invention.

Thus, as illustrated most clearly in FIG. 14, by coordinated flexing of the rib tab elements 187 and the spine tab elements 197, via the rib hinge portion 184 and the spine hinge portion 194, the assembled perimeter rails 160 and 170, rib elements 180, and spine elements 190 are able to be folded or collapsed to a reduced sized assembly. As the elements of the foundation assembly 100 are moved between the folded or collapsed position and the unfolded or expanded position, the rib hinge portions 184 and the spine hinge portions 194 flex to allow the elements to move relative to one another, while allowing the spine tab elements 197 to remain attached or coupled to the side rail elements 170 and the rib tab elements 187 to remain attached or coupled to the header rail elements 160. Likewise, the half-lap rib joints 185 pivot within the half-lap spine joints 195.

When collapsed or folded, the initial support structure of the foundation assembly 100 can be easily packaged for storage, shipment, or sale.

Figure 16:
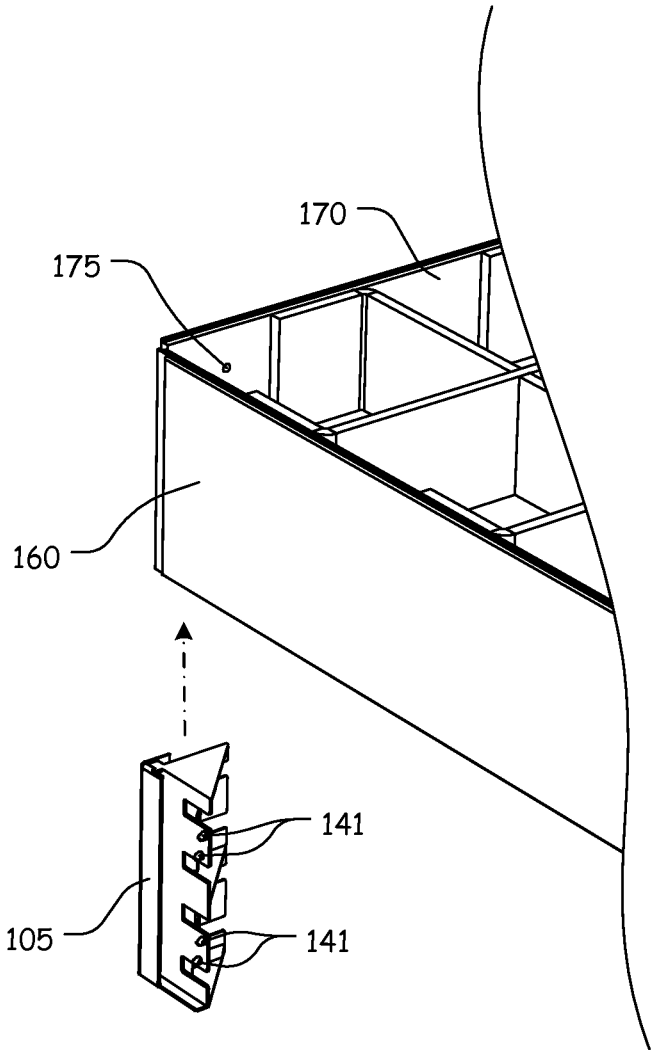
FIG. 16 shows a perspective view of the assembled rib elements, spine elements, and perimeter rails, in an unfolded or expanded configuration, wherein an exemplary corner connector element is being attached or coupled between adjacent perimeter rails, according to this invention.
Figure 17:
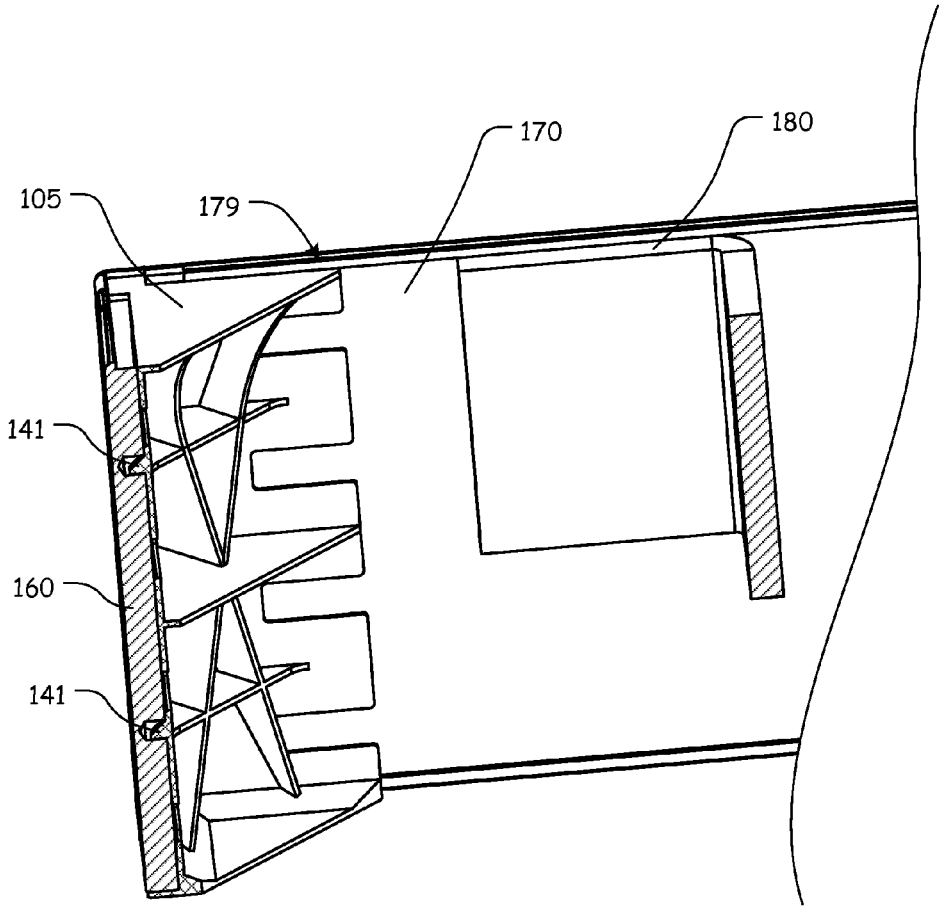
FIG. 17 shows a cutaway, perspective view of the assembled rib elements, spine elements, and perimeter rails, in an unfolded or expanded configuration, wherein an exemplary corner connector element is attached or coupled between adjacent perimeter rails, according to this invention.

In order to construct a foundation assembly 100, the initial support structure of the foundation assembly 100 is unpackaged and manipulated from the collapsed or folded position to the unfolded or expanded position. A corner connector element 105 is positioned at a location proximate each corner of the unfolded or expanded initial support structure of the foundation assembly 100. Then, as illustrated in FIGS. 16 and 17, the header elements 160 and the side rail elements 170 are each attached or coupled, at their appropriate ends, to an appropriately corresponding corner connector element 105. In various exemplary embodiments, the various header elements 160 and side rail elements 170 may be coupled, via fastening elements or means, such as, for example, screws, to the corner connector elements 105. Alternatively, the various header elements 160 and side rail elements 170 may be secured to the corner connector elements 105 via an adhesive.

Each of the header elements 160 and side rail elements 170 has at least one groove or recessed portion 167 formed on an interior side of the element. These one or more grooves 167 are formed so as to accept at least a portion of a protrusion 141, as described below.

Due to the shape and placement of the corner connector elements 105, so long as the header elements 160 are of an equal length and the side rail elements 170 are of an equal length, when unfolded or expanded, a longitudinal axis, $A_L$, of the rib elements 180 is substantially perpendicular to a longitudinal axis, $A_L$, of the spine elements 190. Likewise, the longitudinal axes of the side rail elements 170 are substantially parallel to one another and the longitudinal axes of the header elements 160 are substantially parallel to one another.

FIGS. 9-12 show various views of an exemplary header element 160, according to this invention. It should be appreciated that the elements of the header element 160 correspond to and operates similarly to the corresponding elements of the side rail elements 170. Typically, the difference between the header elements 160 and the side rail elements 170 is there overall length. In certain exemplary embodiments, the length of the side rail elements 170 is equal to the length of the header rail elements 160. Alternatively, the length of the header elements 160 may be different from the length of the side road elements 170.

Figure 10:
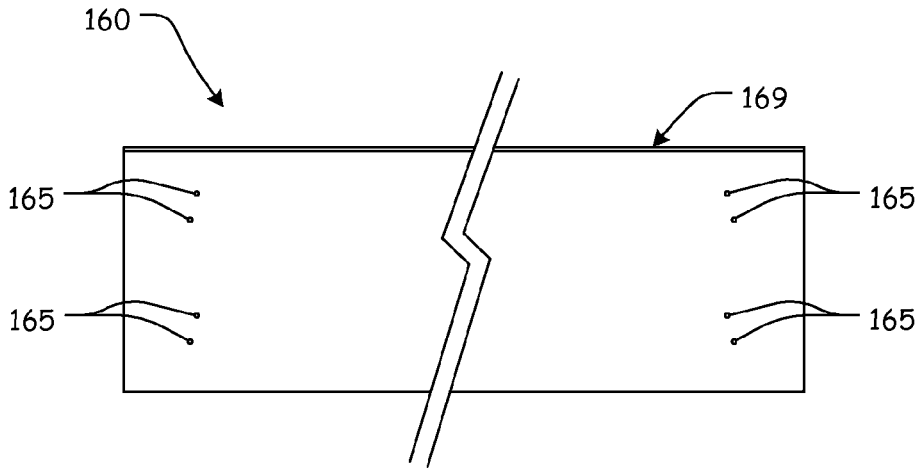
FIG. 10 shows a side view of an inner wall of a first exemplary embodiment of a perimeter rail, according to this invention.
Figure 11:
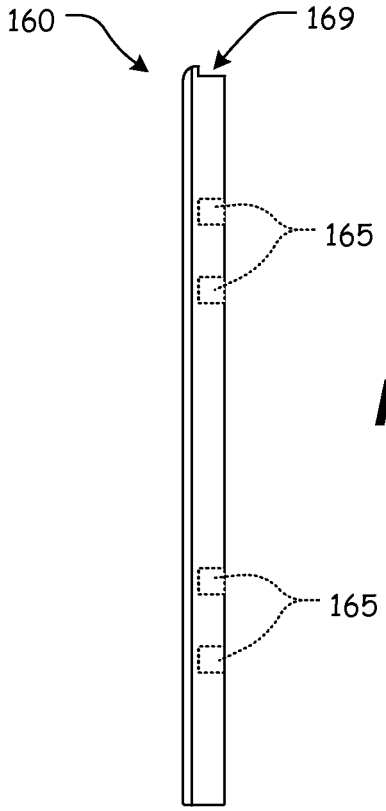
FIG. 11 shows an end view of a first exemplary embodiment of a perimeter rail, according to this invention.
Figure 12:
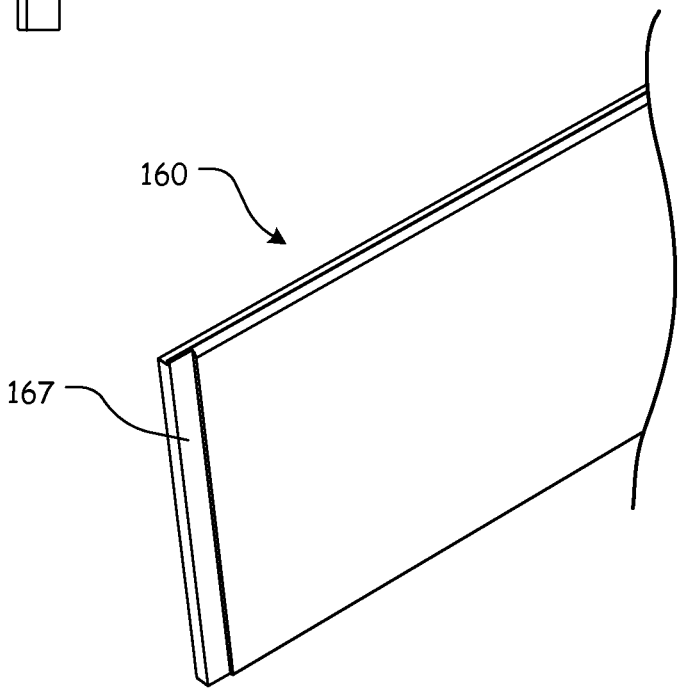
FIG. 12 shows an end perspective view of a first exemplary embodiment of an outer wall of a perimeter rail, according to this invention.
Figure 13:
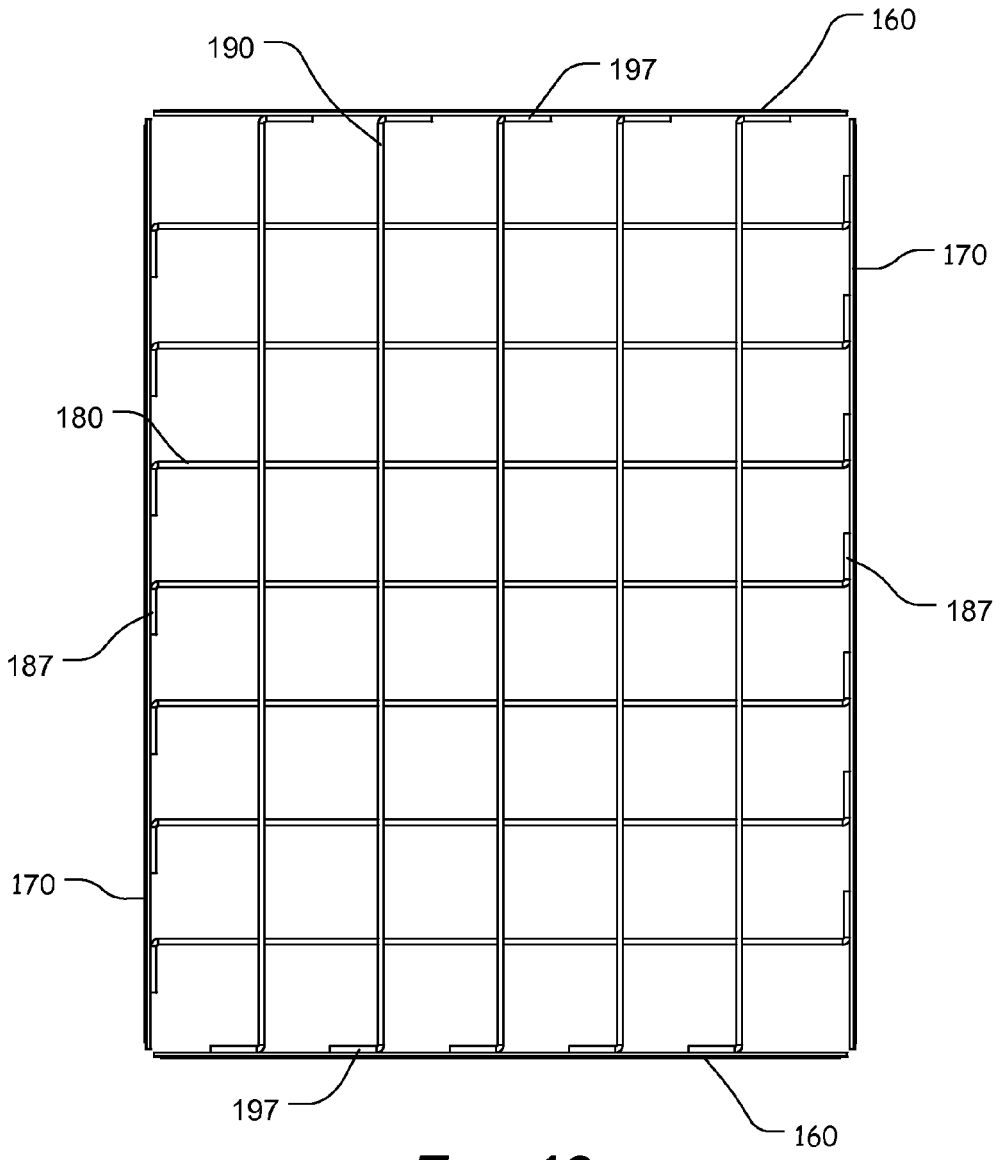
FIG. 13 shows a top view of the assembled rib elements, spine elements, and perimeter rails, in an unfolded or expanded configuration, according to this invention.

As illustrated most clearly in FIGS. 10 and 12, the header elements 160 may optionally include a recessed notch 169 formed so as to accommodate a flush-mounted top deck panel 182. Likewise, the side rail elements 170 may also optionally include a recessed notch 179 formed so as to accommodate a flash-mounted top deck panel 182.

Figure 18:
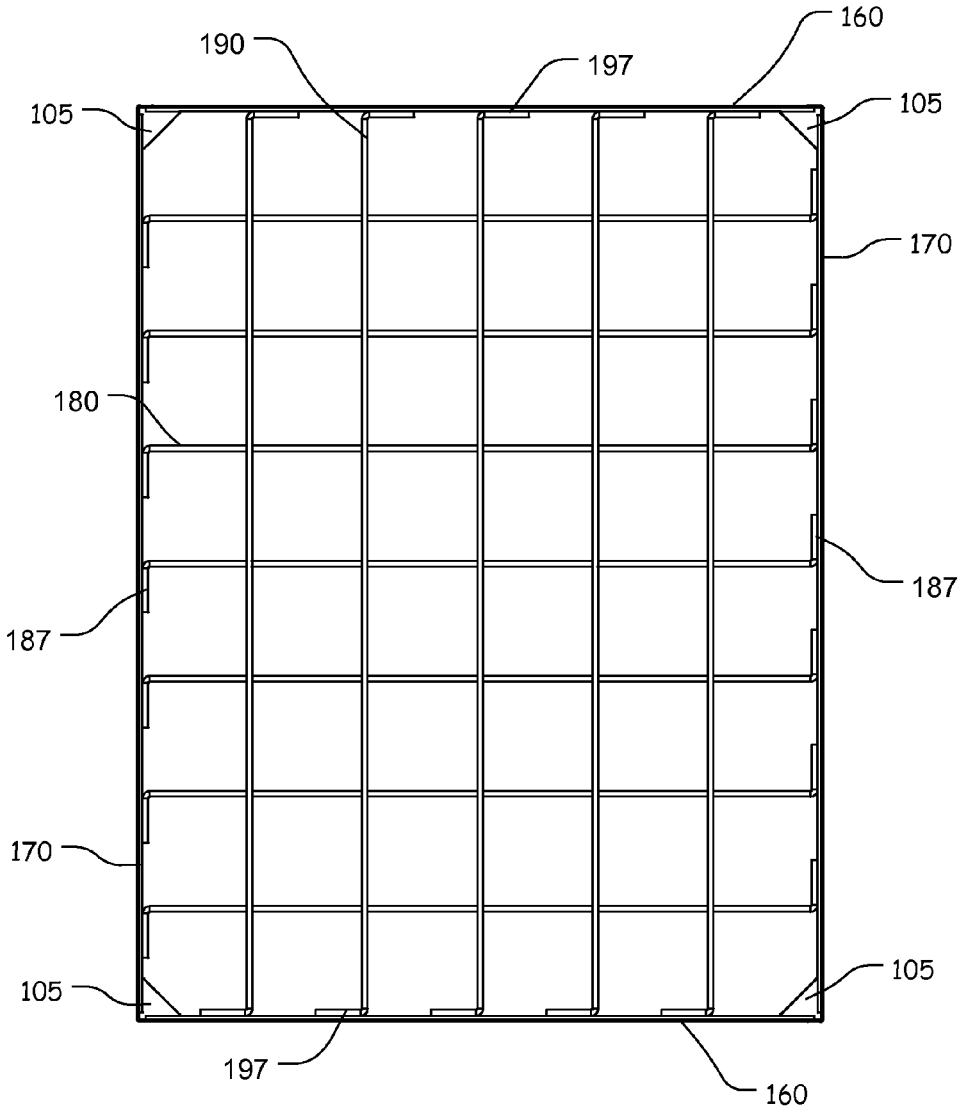
FIG. 18 shows a top view of the assembled rib elements, spine elements, perimeter rails, and corner connector elements in an unfolded or expanded configuration, according to this invention.
Figure 19:
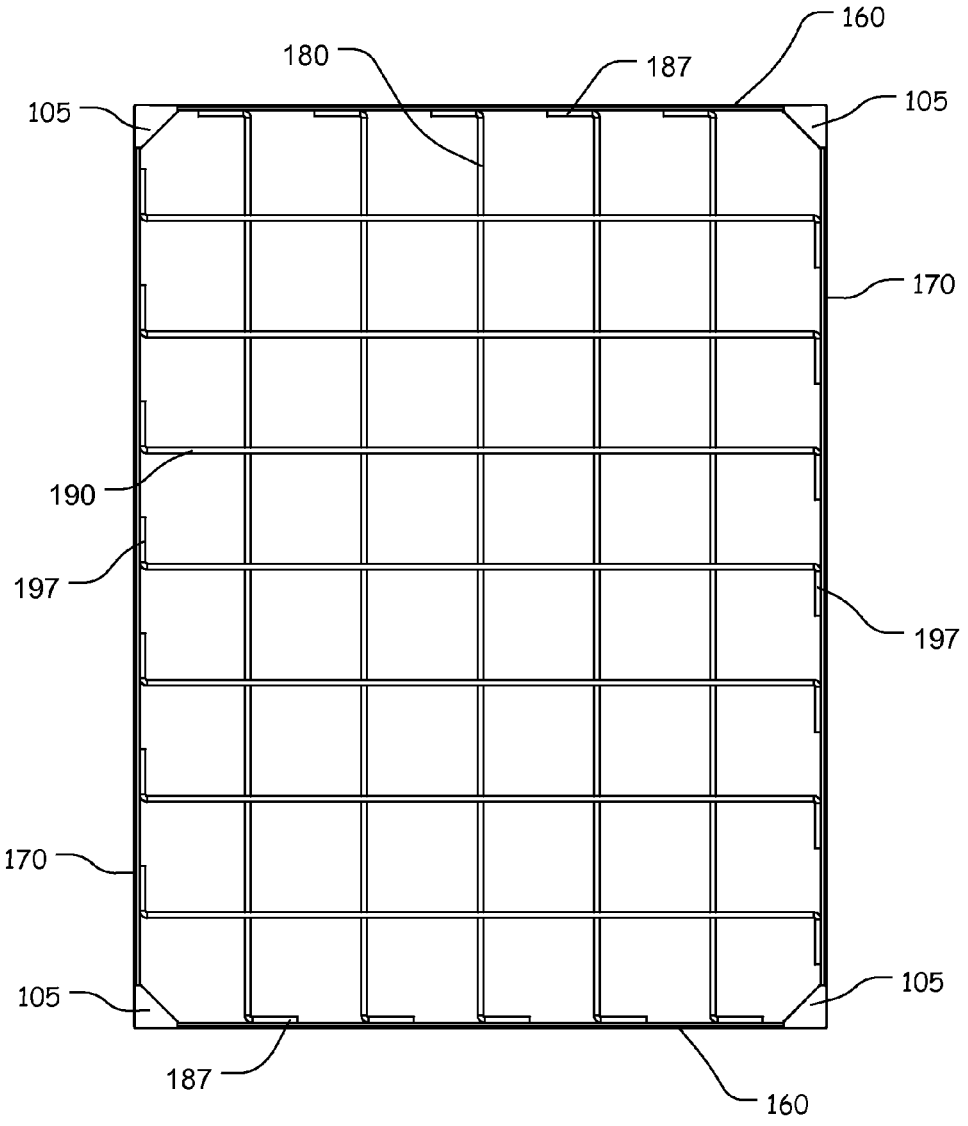
FIG. 19 shows a bottom view of the assembled rib elements, spine elements, perimeter rails, and corner connector elements in an unfolded or expanded configuration, according to this invention.
Figure 20:
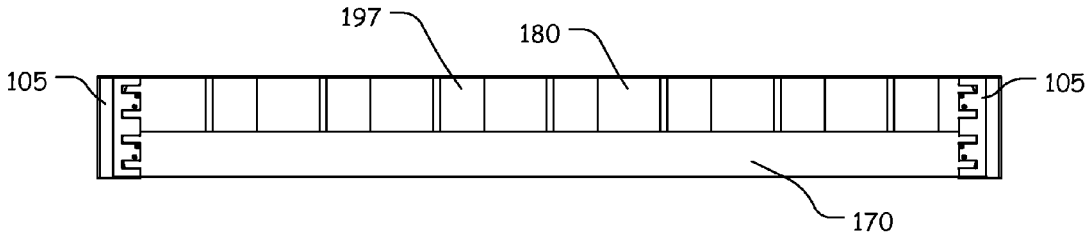
FIG. 20 shows a side view of the assembled rib elements, spine elements, perimeter rails, and corner connector elements in an unfolded or expanded configuration, according to this invention.
Figure 21:
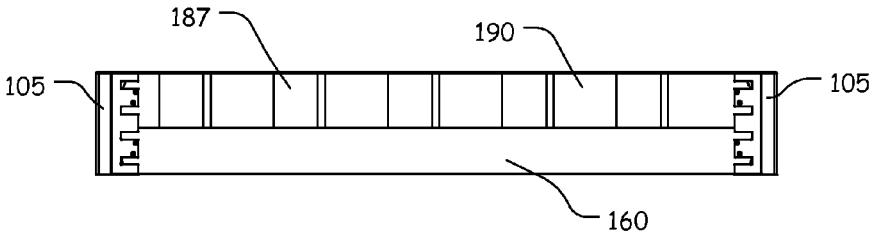
FIG. 21 shows an end view of the assembled rib elements, spine elements, perimeter rails, and corner connector elements in an unfolded or expanded configuration, according to this invention.

FIGS. 18 and 19 show a top view and a bottom view, respectively, of a partially assembled foundation, wherein the deck panel 182 has not yet been added to the assembly 100. Once each of the corner connector elements 105, header elements 160, and side wall elements 170 are attached, coupled, or secured together, the assembly 100 is partially assembled as illustrated in FIGS. 18 and 19.

Figure 22:
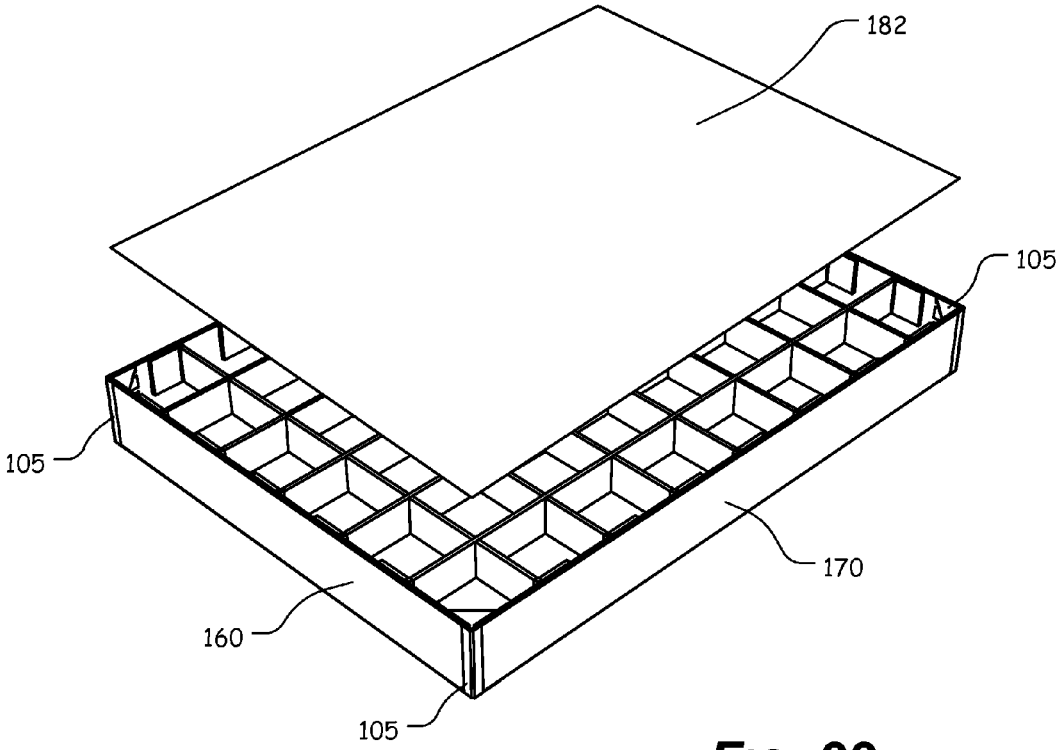
FIG. 22 shows an upper, perspective view of the assembled rib elements, spine elements, perimeter rails, corner connector elements, and top deck panel, in an unfolded or expanded configuration, according to this invention.
Figure 23:
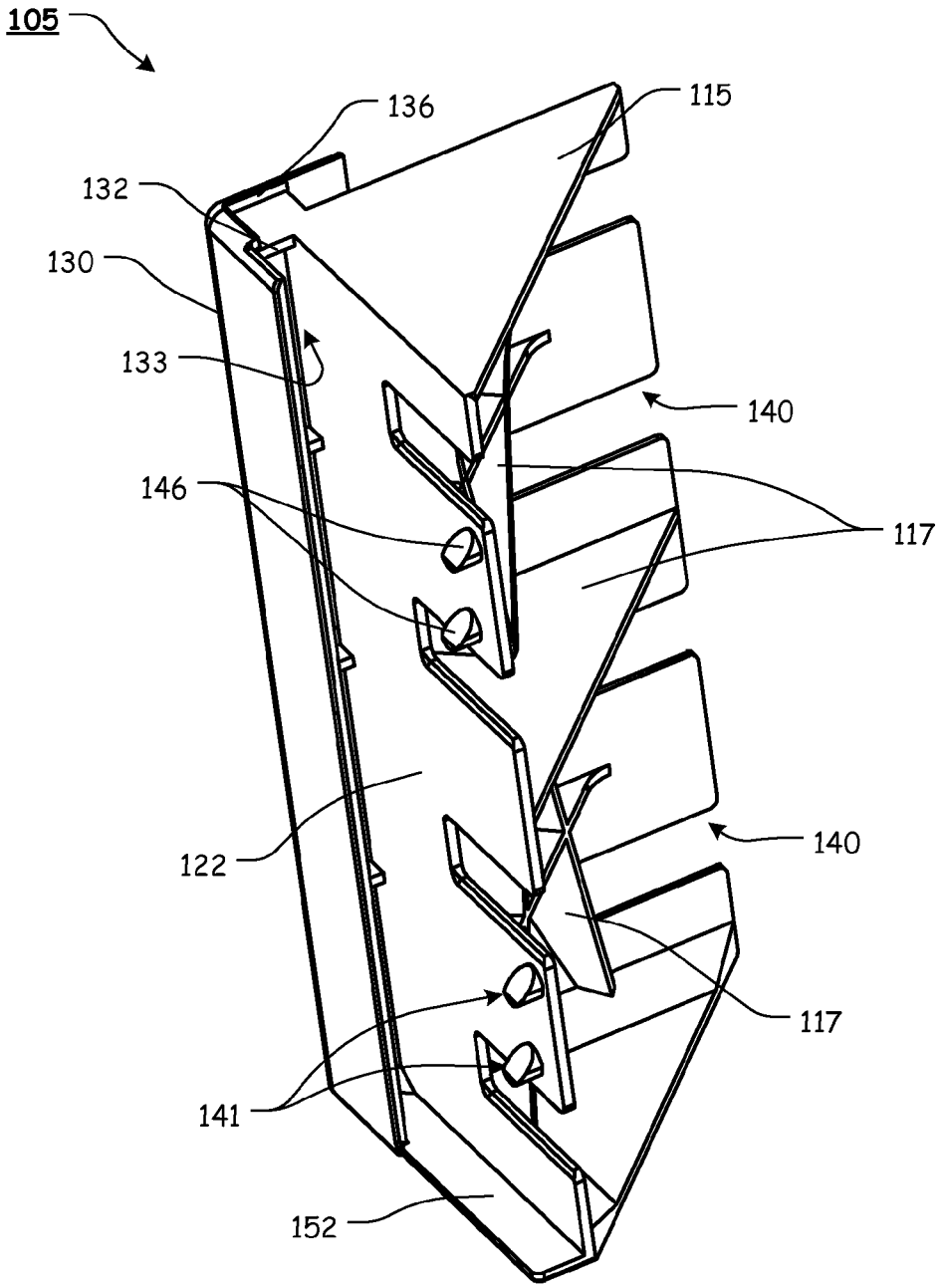
FIG. 23 shows a left perspective view of a first exemplary embodiment of a corner connector element according to this invention.
Figure 24:
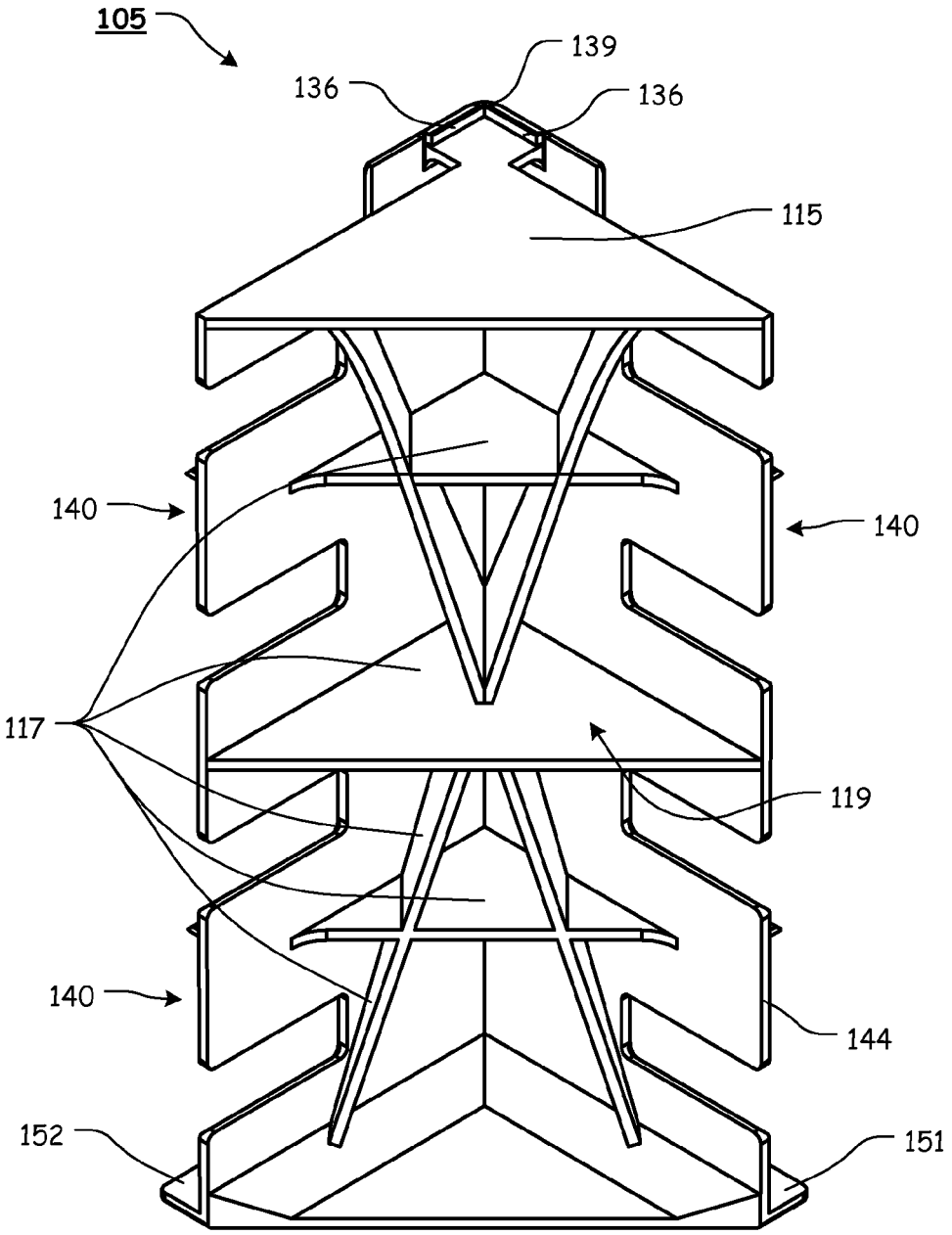
FIG. 24 shows a front perspective view of a first exemplary embodiment of a corner connector element according to this invention.
Figures 25, 26:
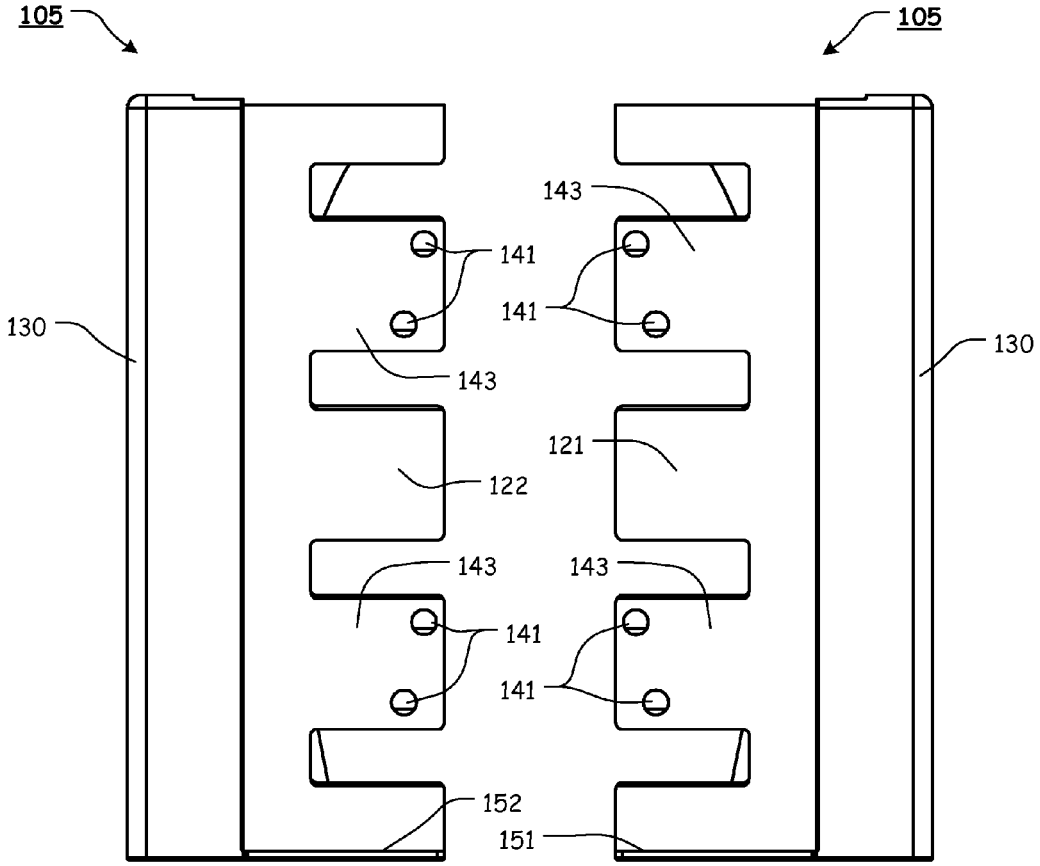
FIG. 25 shows a left plan view of a first exemplary embodiment of a corner connector element according to this invention.
FIG. 26 shows a right plan view of a first exemplary embodiment of a corner connector element according to this invention.
Figure 27:
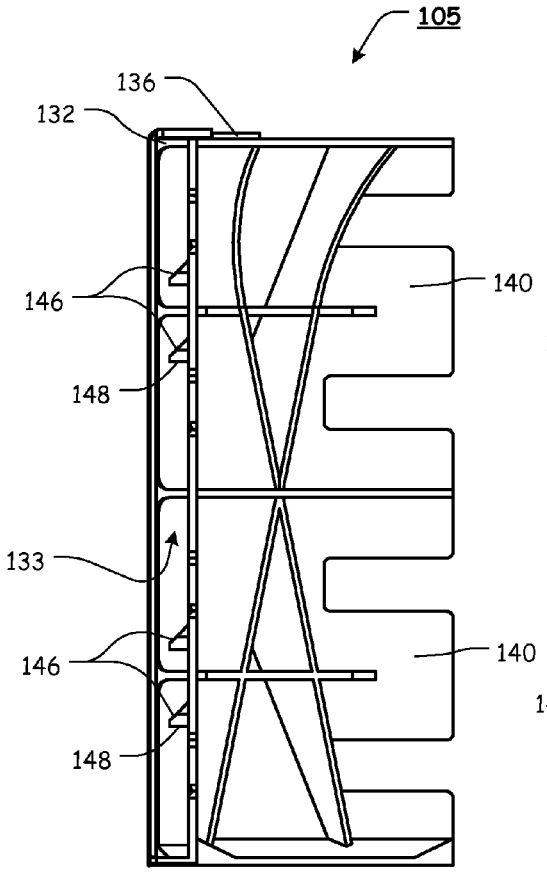
FIG. 27 shows a left side view of a first exemplary embodiment of a corner connector element according to this invention.
Figure 28:
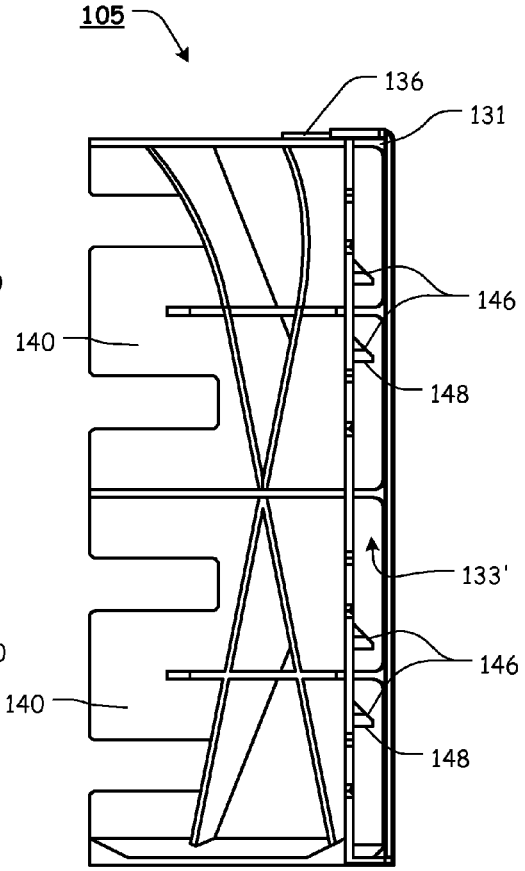
FIG. 28 shows a right side view of a first exemplary embodiment of a corner connector element according to this invention.
Figure 29:
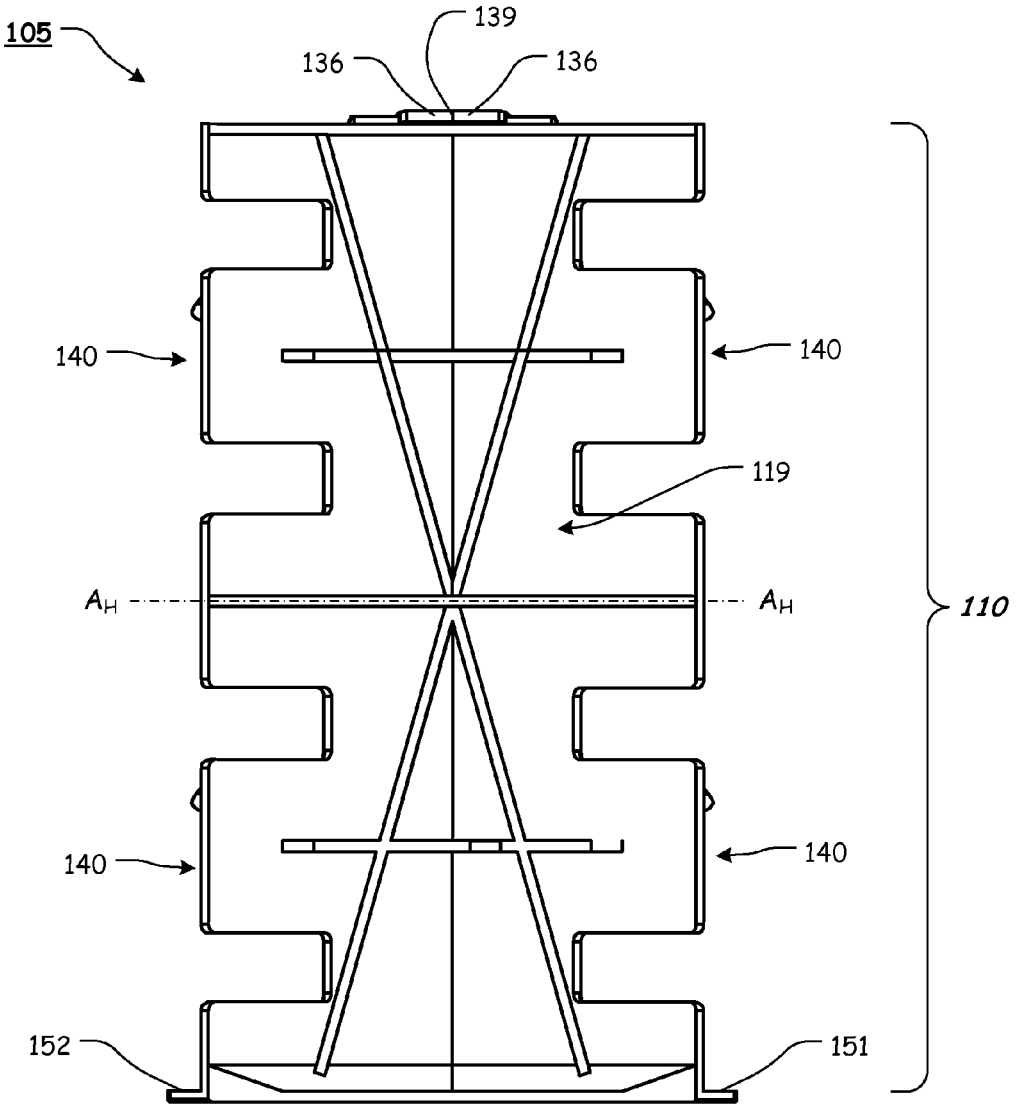
FIG. 29 shows a front view of a first exemplary embodiment of a corner connector element according to this invention.
Figure 30:
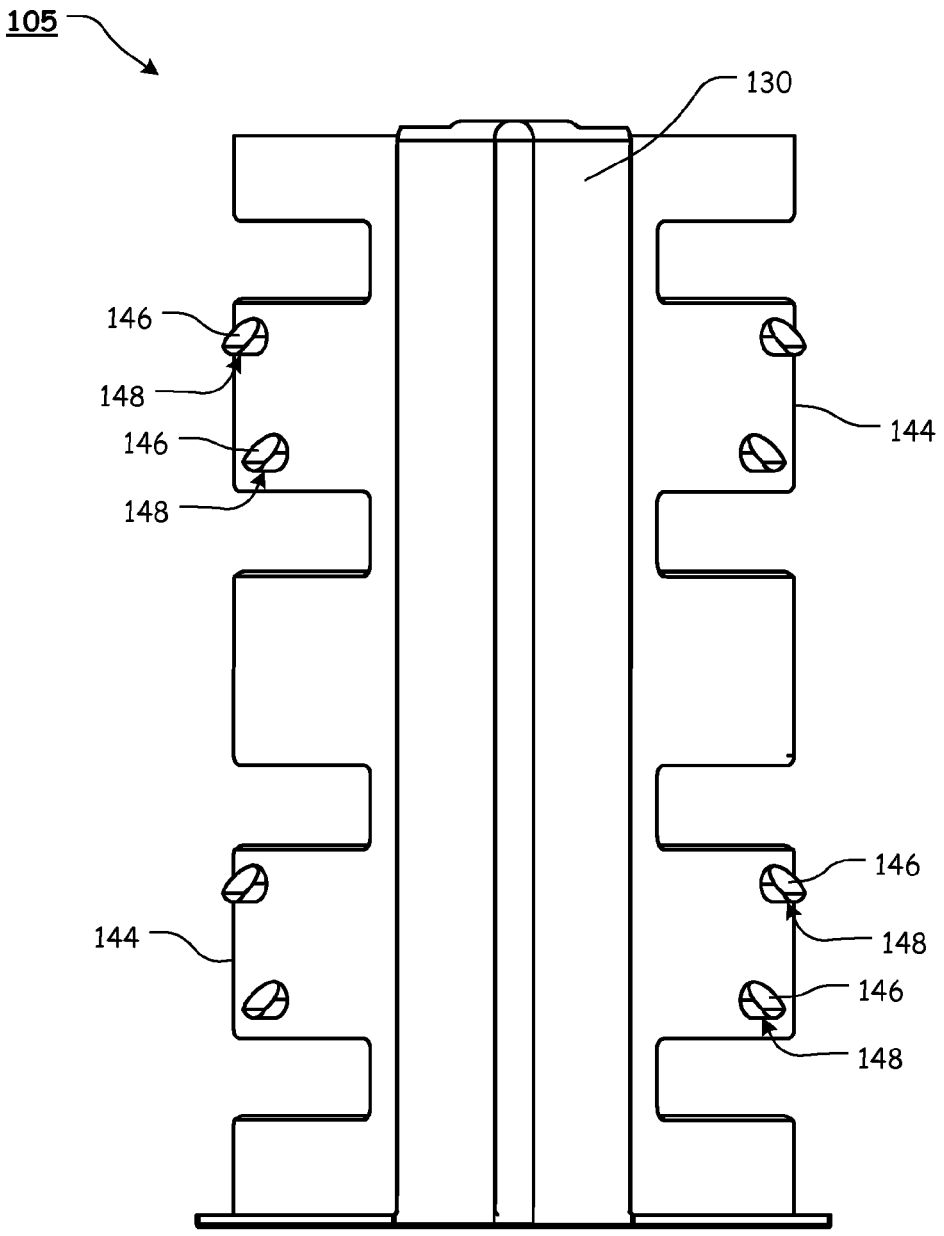
FIG. 30 shows a rear view of a first exemplary embodiment of a corner connector element according to this invention.
Figure 31:
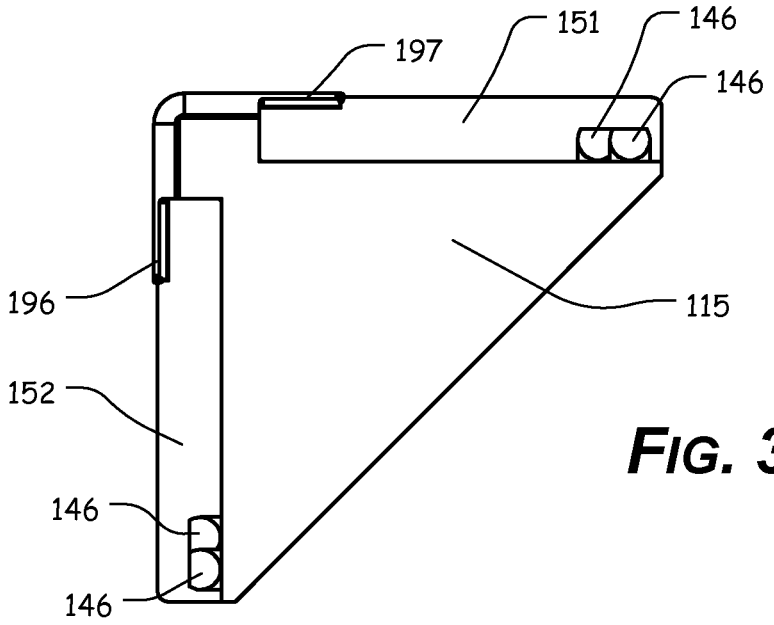
FIG. 31 shows a top view of a first exemplary embodiment of a corner connector element according to this invention.
Figure 32:
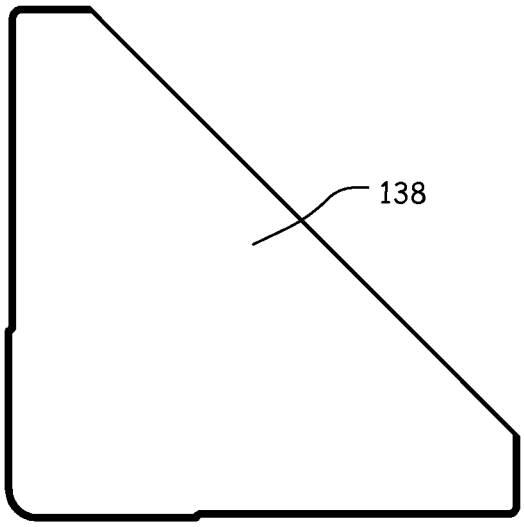
FIG. 32 shows a bottom view of a first exemplary embodiment of a corner connector element according to this invention.
Figure 33:
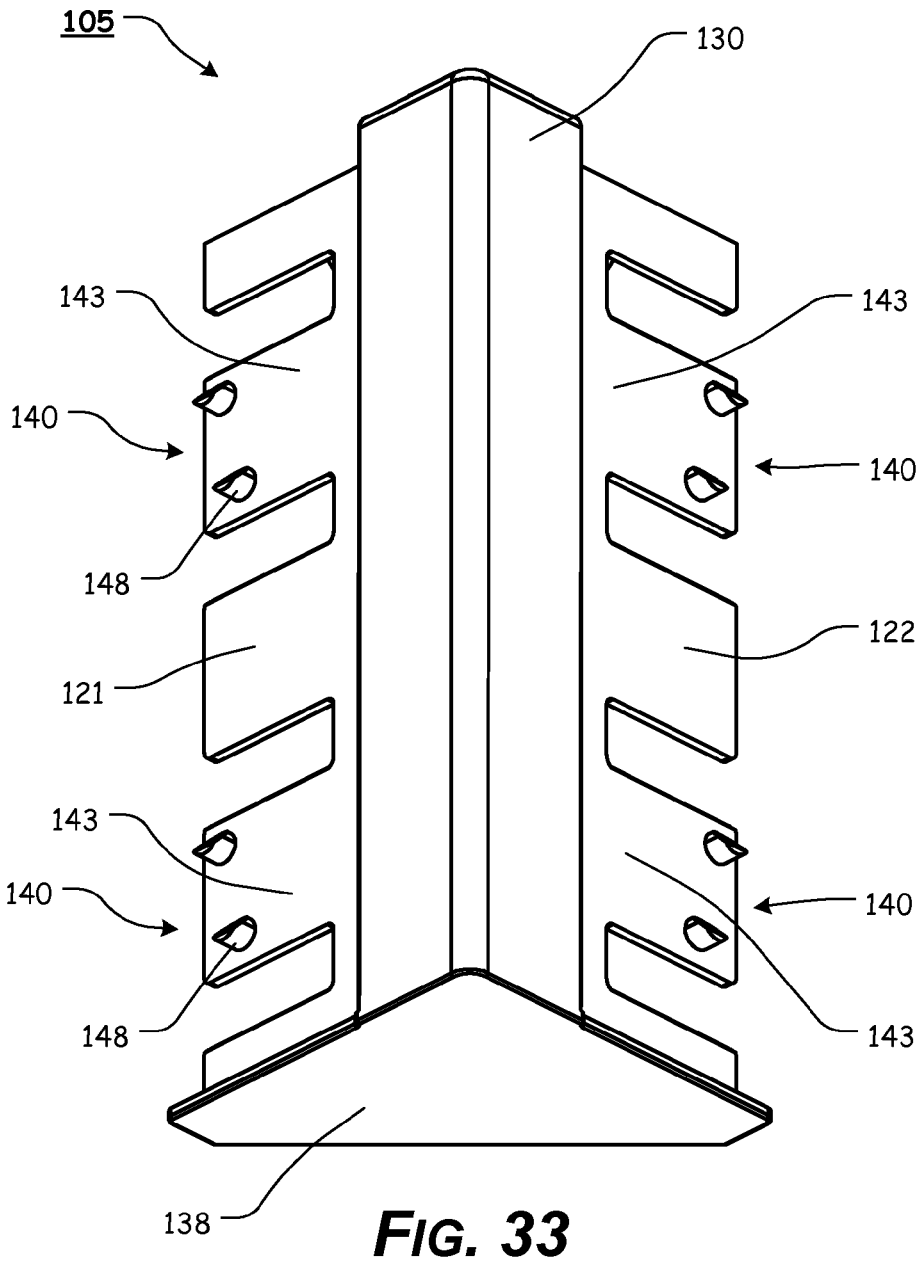
FIG. 33 shows a bottom perspective view of a first exemplary embodiment of a corner connector element according to this invention.

Finally, as illustrated in FIG. 22, the top deck panel 182 can be placed atop the rib elements 180 and spine elements 190, within the recessed notches 169 and 179, so as to be flush-mounted with a top surface of the header elements 160 and the side rail elements 170.

The top deck panel 182 is typically a sheet of thinner MDF, or other material, which provides a single, solid surface upon which a mattress will sit. A solid top deck panel 182 is particularly critical for foam mattresses and is a major improvement over currently constructed mattress foundations, which use soft cardboard atop lumber slats.

Once assembled, the foundation assembly 100 can be placed in a bed frame (not shown) for receiving a mattress.

FIGS. 23-33 illustrate a first exemplary embodiment of a corner connector element 105 according to this invention. In an illustrative, non-limiting embodiment of this invention, as illustrated in FIGS. 23-33, the corner connector element 105 comprises at least some of a main body portion 110, an upper deck panel support surface 115, a first side surface 121, a second side surface 122, a corner surface 130, a first abutment surface 131, a second abutment surface 132, a deck panel corner abutment surface 136, a corner 139, a first side support shoulder 151, and a second side support shoulder 152.

As illustrated in FIGS. 23-33, the main body portion 110 extends from the substantially planar first side support shoulder 151 to the substantially planar upper deck panel support surface 115 and from the substantially planar second side support shoulder 152 to the substantially planar upper deck panel support surface 115. The first side support shoulder 151 extends perpendicular to the first abutment surface 131, proximate the bottom surface 138. Similarly, the second side support shoulder 152 extends perpendicular to the second abutment surface 132, proximate the bottom surface 138.

The first abutment surface 131 extends substantially perpendicularly from a terminating edge of the first side surface 121. Likewise, the second abutment surface 132 extends substantially perpendicularly from a terminating edge of the second side surface 122. The corner surface 130 extends from a terminating edge of the first abutment surface 131 to a terminating edge of the second abutment surface 132.

A first portion of the first abutment surface 131 and the second abutment surface 132 extend above the upper deck panel support surface 115, while a second portion of the first abutment surface 131 and the second abutment surface 132 terminates at the upper deck panel support surface 115.

In various exemplary embodiments, as illustrated in FIGS. 23-33, an interior portion of the main body portion 110 is defined substantially between the first side support shoulder 151, the second side support shoulder 152, the upper deck panel support surface 115, the first side surface 121, and the second side surface 122, and is at least partially hollow. In these exemplary embodiments, one or more ribs 117 may optionally be formed within a hollow portion 119 of the interior portion. The one or more ribs 117 may provide additional strength and/or rigidity to the main body portion 110.

In various exemplary embodiments, the deck panel corner abutment surfaces 136 each extend substantially perpendicularly from a terminating edge of the upper deck panel support surface 115.

The corner 139 is defined by the deck panel corner abutment surfaces 136. In various exemplary embodiments, the deck panel corner abutment surface 136 is a curved surface.

In various exemplary embodiments, one or more recesses 133 are optionally formed in an area between the second abutment surfaces 132. Similarly, one or more recesses 133' are optionally formed in an area between the first abutment surfaces 131. The one or more recesses 133 and/or 133' may provide additional strength and/or rigidity to the corner connector element 105.

At least one first deflectable flexible finger 140 extends from the first abutment surface 131. At least a portion of a primary surface 143 of the at least one first deflectable flexible finger 140 extends substantially perpendicular to the first abutment surface 131, and wherein the at least one first deflectable flexible finger 140 comprises one or more protrusions 141 that extend, proximate an end portion 144 of the at least one first deflectable flexible finger 140, beyond the primary surface 143 of the at least one first deflectable flexible finger 140. Each protrusion 141 includes a camming surface 146 and a shoulder 148.

At least one second deflectable flexible finger 140 extends from the second abutment surface 132. At least a portion of a primary surface 143 of the at least one second deflectable flexible finger 140 extends substantially perpendicular to the second abutment surface 132, and wherein the at least one second deflectable flexible finger 140 comprises a protrusion 141 that extends, proximate an end portion 144 of the at least one second deflectable flexible finger 140, beyond the primary surface 143 of the at least one second deflectable flexible finger 140. Each protrusion 141 includes a camming surface 146 and a shoulder 148.

An upper slat support surface 190 extends substantially parallel to the upper deck panel support surface 115, but at a level that is lower than the deck panel support surface 115 and a lower slat support surface 190' that extends substantially parallel to the first side support shoulder 151 and the second side support shoulder 152, but at a level that is higher than the first side support shoulder 151 and the second side support shoulder 152.

In various exemplary, nonlimiting embodiments, the corner connector element 105 of the present invention also includes a substantially planar first side surface 121 and a substantially planar second side surface 122. At least a portion of the first side surface 121 extends substantially perpendicular to the first abutment surface 131 and at least a portion of the second side surface 122 extends substantially perpendicular to the second abutment surface 132. The first side surface 121 and the second side surface 122 are formed at substantially 90° relative to one another, the primary surface 143 of the at least one first deflectable flexible finger 140 is substantially parallel to the first side surface 121, and the primary surface 143 of the at least one second deflectable flexible finger 140 is substantially parallel to the second side surface 122.

In various exemplary embodiments, the corner connector element 105 is substantially rigid and is formed of a polymeric material such as a polymeric composite. Alternate materials of construction may include one or more of the following: wood, steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the corner connector element 105 is a design choice based on the desired appearance and functionality of the corner connector element 105.

It should be appreciated that the corner connector element 105 may be integrally formed. Alternatively, suitable materials can be used and sections are elements made independently and attached or coupled together, such as by adhesives, staples, screws, nails, or other fasteners, to form the corner connector element 105.

It should be understood that the overall size and shape of the corner connector element 105, and the various portions thereof, is a design choice based upon the desired functionality and/or appearance of the corner connector element 105. Additionally, it should be appreciated that the corner connector element 105 is formed such that multiple corner connector elements 105 may be positioned and used as each of the four corners of a foundation assembly 100. Therefore, multiple connector elements do not have to be formed for a specific location at a specific corner of a foundation assembly 100.

As illustrated in FIGS. 16-22, the corner connector element 105 may be used to construct a foundation assembly 100. As illustrated in FIGS. 16-22, the foundation assembly 100 comprises at least some of a plurality of corner connector elements 105, header elements 160, each having recessed portions 167, protrusion receiving grooves 165, and a recessed notch 169, side rail elements 170, each having recessed portions 177, protrusion receiving grooves 175, and a recessed notch 179.

The recessed portions 167 and 177 are formed so as to be received within the recess 133 formed between the first side surface 121 and the retaining wall 196 and the second side surface 122 and the retaining wall 197.

Each of the header elements 160 has at least one protrusion receiving groove 165 formed on an interior side of the header element 160. These one or more protrusion receiving grooves 165 are formed so as to accept at least a portion of a protrusion 141, as described herein.

Due to the shape and placement of the first side surface 121, the second side surface 122, the first abutment surface 131, and the second abutment surface 132, so long as the header elements 160 are of an equal length and the side rail elements 170 are of an equal length, and so long as each of the header elements 160 and the side rail elements 170 has a terminating end that is parallel and perpendicular to the longitudinal axis of the element, when the interior side of the element is positioned against a corresponding first side surface 121 or the second side surface 122 of a corner connector element 105 and the terminating end is positioned against a corresponding first abutment surface 131 or second abutment surface 132, the header elements 160 will be parallel to one another and the side rail elements 170 will be parallel to one another.

While elements of the header elements 160 are illustrated in FIGS. 9-12. It should be appreciated that the features of the side rail elements 170 correspond to the elements of the header elements 160 and may, in fact, be identical to the elements of the header elements 160. However, typically the rail elements 170 are longer in length than the header elements 160.

In order to secure the foundation assembly 100 in the unfolded or expanded position, four corner connector elements 105 are positioned at locations proximate the four corners of the unfolded or expanded foundation assembly 100. When properly positioned, the corner connector elements 105 are guided along the header elements 160 and the side rail elements 170, by the interaction between the recessed portions 167 and 177, the side surfaces 121 and 122, and the retaining walls 196 and 197.

In this manner, as an end surface of the header elements 160 and the side rail elements 170 contacts an appropriate first abutment surface 131 or second abutment surface 132, an outer surface of the header elements 160 (within the recessed portion 167) and the side rail elements 170 (within the recessed portion 177) contacts an inner surface of the retaining walls 197, and an inner surface of the header elements 160 and the side rail elements 170 contacts an appropriate first side surface 121 or second side surface 122.

As illustrated in FIGS. 16 and 17, a corner connector element 105 is properly aligned with and urged upward, along a side rail element 170, the side surface 122 and/or a portion of the primary surface 143 contacts an inner surface of the side rail element 170. As the corner connector element 105 is urged further, the camming surface 146 of each sequential protrusion 141 contacts the inner surface of the side rail element 170 and each finger 140 is flexed inwardly so as to ride along the inner surface of the side rail element 170.

The fingers 140 continue to be flexed inwardly until shoulders 148 pass beyond an edge of the protrusion receiving grooves 175, whereupon the spring bias of the stressed fingers 140 causes the fingers 140 to snap outwardly and the protrusions 141 are urged into the protrusion receiving grooves 175, to assume the position as illustrated in FIG. 17.

When the protrusions 141 are positioned within the protrusion receiving grooves 175, the shoulder 148 contacts and engages a sidewall surface of the protrusion receiving groove 175, firmly mounting the side rail element 170 on the corner connector element 105. When assembled, the interaction of the protrusions 141 with the protrusion receiving grooves 175 restrain axial movement of the side rail elements 170 with respect to the corner connector elements 105. Particularly, when a withdrawing force is applied to the side rail element 170, the abutting relation of the shoulders 104 and the protrusion receiving grooves 175 will preclude axial movement, thereby precluding the disengagement of the corner connector element 105 and the side rail element 170.

It is further noted that if the angle of the shoulder 148 includes an undercut, the greater the withdrawing force applied the side rail element 170, the stronger the engagement between the protrusions 141 and the protrusion receiving grooves 175 becomes, as the withdrawing force will cause protrusions 141 to further flex inward restraining the movement of the side rail element 170.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A collapsible, multi-lap foundation assembly, comprising:

four shaped perimeter rails;

a plurality of rib elements, wherein each rib element comprises an elongate, central rib portion having a rib tab element formed at each end of the central rib portion, wherein the rib tab elements are able to flex, via a rib hinge portion, relative to the central rib portion, and wherein a plurality of half-lap rib joints extend from an upper portion of the central rib portion at spaced apart locations; and a plurality of spine elements, wherein each spine element comprises an elongate, central spine portion having a spine tab element formed at each end of the central spine portion, wherein the spine tab elements are able to flex, via a spine hinge portion, relative to the central spine portion, and wherein a plurality of half-lap spine joints extend from a lower portion of the central spine portion at spaced apart locations;

wherein the spine elements are aligned with the rib elements in an interlocking fashion via interaction of mating half-lap rib joints and half-lap spine joints, such that the spine elements are pivotable relative to the rib elements via interaction of mating half-lap rib joints and half-lap spine joints; and wherein the rib tab elements are attached or coupled to an interior surface of two perimeter rails at spaced apart locations, and wherein the spine tab elements are attached or coupled to an interior surface of two perimeter rails at spaced apart locations.

2. The foundation assembly of claim 1, further comprising a corner connector element positioned at each corner of the unfolded or expanded foundation assembly, between adjacent perimeter rails.

3. The foundation assembly of claim 1, wherein the perimeter rails comprise first and second side rail elements and first and second header elements.

4. The foundation assembly of claim 1, wherein the rib hinge portion comprises a crimp or fold line formed in the rib element and wherein the spine hinge portion comprises a crimp or fold line formed in the spine element.

5. The foundation assembly of claim 1, wherein the rib hinge portion comprises a fabric hinge element or a hinge that joins the rib tab element to the central rib portion and wherein the spine hinge portion comprises a fabric hinge element or a hinge that joins the spine tab element to the central spine portion.

6. The foundation assembly of claim 1, wherein the number of half-lap rib joints corresponds to the number of half-lap spine joints.

7. The foundation assembly of claim 1, wherein the spine tab elements and the rib tab elements are attached or coupled to the interior surface of the perimeter rails via adhesives, screws or other fastening means.

8. The foundation assembly of claim 1, wherein each perimeter rail includes a recessed notch formed in an upper portion of the perimeter rail to accommodate a flush-mounted top deck panel.

9. The foundation assembly of claim 1, wherein, by coordinated flexing of the rib tab elements and the spine tab elements, via the rib hinge portion and the spine hinge portion and pivoting of the half-lap rib joints relative to the half-lap spine joints, the assembled perimeter rails, rib elements, and spine elements are able to be repositioned from a folded or collapsed position to an unfolded or expanded position.

10. The foundation assembly of claim 1, wherein, by coordinated flexing of the rib tab elements and the spine tab elements, via the rib hinge portion and the spine hinge portion and pivoting of the half-lap rib joints relative to the half-lap spine joints, the assembled perimeter rails, rib elements, and spine elements are able to be repositioned from a folded or collapsed position to an unfolded or expanded position while allowing the spine tab elements to remain attached or coupled to the perimeter rails and the rib tab elements to remain attached or coupled to the perimeter rails.

11. The foundation assembly of claim 1, wherein a top deck panel is placed atop the rib elements and spine elements, within the recessed notches, so as to be flush-mounted with a top surface of the perimeter rails.

12. A collapsible, multi-lap foundation assembly, comprising:

first and second side rail elements and first and second header elements;

a plurality of rib elements, wherein each rib element comprises an elongate, central rib portion having a rib tab element formed at each end of the central rib portion, wherein the rib tab elements are able to flex, via a rib hinge portion, relative to the central rib portion, and wherein a plurality of half-lap rib joints extend from an upper portion of the central rib portion at spaced apart locations; and a plurality of spine elements, wherein each spine element comprises an elongate, central spine portion having a spine tab element formed at each end of the central spine portion, wherein the spine tab elements are able to flex, via a spine hinge portion, relative to the central spine portion, and wherein a plurality of half-lap spine joints extend from a lower portion of the central spine portion at spaced apart locations;

wherein the spine elements are aligned with the rib elements in an interlocking fashion via interaction of mating half-lap rib joints and half-lap spine joints, such that the spine elements are pivotable relative to the rib elements via interaction of mating half-lap rib joints and half-lap spine joints;

wherein the rib tab elements are attached or coupled to an interior surface of the side rail elements at spaced apart locations, and wherein the spine tab elements are attached or coupled to an interior surface of the header elements at spaced apart locations; and wherein, by coordinated flexing of the rib tab elements and the spine tab elements, via the rib hinge portion and the spine hinge portion and pivoting of the half-lap rib joints relative to the half-lap spine joints, the assembled side rail elements, header elements, rib elements, and spine elements are able to be repositioned from a folded or collapsed position to an unfolded or expanded position, while allowing the spine tab elements to remain attached or coupled to the header rail elements and the rib tab elements to remain attached or coupled to the side rail elements.

13. The method of claim 12, further comprising a corner connector element positioned at each corner of the unfolded or expanded foundation assembly, between two adjacent header elements and side rail elements.

14. The method of claim 12, wherein a top deck panel is placed atop the rib elements and spine elements, within the recessed notches, so as to be flush-mounted with a top surface of the header elements and the side rail elements.

15. The foundation assembly of claim 12, wherein the rib hinge portion comprises a crimp or fold line formed in the rib element and wherein the spine hinge portion comprises a crimp or fold line formed in the spine element.

16. The foundation assembly of claim 12, wherein the rib hinge portion comprises a fabric hinge element or a hinge that joins the rib tab element to the central rib portion and wherein the spine hinge portion comprises a fabric hinge element or a hinge that joins the spine tab element to the central spine portion.

17. The foundation assembly of claim 12, wherein the number of half-lap rib joints corresponds to the number of half-lap spine joints.

18. The foundation assembly of claim 12, wherein the spine tab elements and the rib tab elements are attached or coupled to the interior surface of the perimeter rails via adhesives, screws or other fastening means.

19. The foundation assembly of claim 12, wherein each perimeter rail includes a recessed notch formed in an upper portion of the perimeter rail to accommodate a flush-mounted top deck panel.

20. A method for assembling a collapsible, multi-lap foundation assembly, the collapsible, multi-lap foundation assembly comprising:

first and second side rail elements and first and second header elements;

a plurality of rib elements, wherein each rib element comprises an elongate, central rib portion having a rib tab element formed at each end of the central rib portion, wherein the rib tab elements are able to flex, via a rib hinge portion, relative to the central rib portion, and wherein a plurality of half-lap rib joints extend from an upper portion of the central rib portion at spaced apart locations; and a plurality of spine elements, wherein each spine element comprises an elongate, central spine portion having a spine tab element formed at each end of the central spine portion, wherein the spine tab elements are able to flex, via a spine hinge portion, relative to the central spine portion, and wherein a plurality of half-lap spine joints extend from a lower portion of the central spine portion at spaced apart locations;

wherein the spine elements are aligned with the rib elements in an interlocking fashion via interaction of mating half-lap rib joints and half-lap spine joints, such that the spine elements are pivotable relative to the rib elements via interaction of mating half-lap rib joints and half-lap spine joints;

wherein the rib tab elements are attached or coupled to an interior surface of the side rail elements at spaced apart locations, and wherein the spine tab elements are attached or coupled to an interior surface of the header elements at spaced apart locations; and wherein, by coordinated flexing of the rib tab elements and the spine tab elements, via the rib hinge portion and the spine hinge portion and pivoting of the half-lap rib joints relative to the half-lap spine joints, the assembled side rail elements, header elements, rib elements, and spine elements are able to be repositioned from a folded or collapsed position to an unfolded or expanded position, while allowing the spine tab elements to remain attached or coupled to the header rail elements and the rib tab elements to remain attached or coupled to the side rail elements;

the method comprising:

receiving the foundation assembly in a folded or collapsed position;

transitioning the foundation assembly from the folded or collapsed position to an unfolded or expanded position;

attaching a corner connector element at each corner of the unfolded or expanded foundation assembly, between adjacent header elements and side rail elements; and securing a top deck panel atop at least a portion of the header elements, the side rail elements, the rib elements, and the side rail elements.

* * * * *